US012098728B2

(12) United States Patent
Guenther et al.

(10) Patent No.: US 12,098,728 B2
(45) Date of Patent: Sep. 24, 2024

(54) INDUCER FOR A SUBMERSIBLE PUMP FOR PUMPING A SLURRY CONTAINING SOLIDS AND VISCOUS FLUIDS AND METHOD OF DESIGNING SAME

(71) Applicant: DAJUSTCO IP HOLDINGS INC., Coquitlam (CA)

(72) Inventors: Nicholas James Guenther, Coquitlam (CA); Timothy Andrew Phillip Gjernes, Coquitlam (CA)

(73) Assignee: Dajustco IP Holdings Inc., Coquitlam (CA)

( * ) Notice: Subject to any disclaimer, the term of this patent is extended or adjusted under 35 U.S.C. 154(b) by 0 days.

(21) Appl. No.: 17/621,400

(22) PCT Filed: Jun. 29, 2020

(86) PCT No.: PCT/CA2020/050902

§ 371 (c)(1),
(2) Date: Dec. 21, 2021

(87) PCT Pub. No.: WO2020/257947

PCT Pub. Date: Dec. 30, 2020

(65) Prior Publication Data

US 2022/0356885 A1 Nov. 10, 2022

Related U.S. Application Data

(60) Provisional application No. 62/868,093, filed on Jun. 28, 2019.

(30) Foreign Application Priority Data

Jun. 28, 2019 (CA) ..... 3048275

(51) Int. Cl.
*F04D 29/22* (2006.01)
*F04D 7/04* (2006.01)

(52) U.S. Cl.
CPC ..... *F04D 29/2272* (2013.01); *F04D 7/04* (2013.01); *F04D 7/045* (2013.01); *F04D 29/2277* (2013.01)

(58) Field of Classification Search
CPC ..... F04D 29/242; F04D 1/025; F04D 7/06; F04D 29/026; F04D 29/669;
(Continued)

(56) References Cited

U.S. PATENT DOCUMENTS 3,817,653 A * 6/1974 Onal ..... F04D 29/165 415/217.1
4,426,190 A * 1/1984 Shapiro ..... F04D 29/2277 415/74
(Continued)

FOREIGN PATENT DOCUMENTS

CA 2933926 A1 12/2017
CN 201016343 Y 2/2008
(Continued)

OTHER PUBLICATIONS

ISA/CA Canadian Intellectual Property Office, The International Search Report and the Written Opinion of the International Searching Authority, mailed on Sep. 3, 2020 for PCT international application No. PCT/CA2020/050902 filed Jun. 29, 2020.
(Continued)

*Primary Examiner* — Bryan M Lettman
(74) *Attorney, Agent, or Firm* — Wells St. John P.S.

(57) ABSTRACT

An inducer and a submersible pump for pumping a slurry comprising solids and viscous fluids, the inducer mountable to the pump's drive shaft adjacent to and immediately upstream of an impeller mounted on said shaft. The inducer comprises a hub, two to four inducer blades extending outwardly from and wrapping helically around the hub, the hub and the inducer blades defining a plurality of channels
(Continued)

A trailing edge of each inducer blade is positioned snugly adjacent to and in fluidical alignment with a leading edge of a corresponding impeller blade when the inducer is mounted on the drive shaft of the pump, such that a velocity curve of the slurry is smooth as the slurry travels from a leading edge of the inducer blades to the leading edge of the impeller blades.

17 Claims, 18 Drawing Sheets

(58) Field of Classification Search
CPC ..... F04D 29/2277; F04D 1/02; F04D 29/007; F04D 29/245; F04D 29/046; F04D 7/04; F04D 7/045; F04D 29/2272; F04D 29/2288
See application file for complete search history.

(56) References Cited

U.S. PATENT DOCUMENTS 4,481,020 A * 11/1984 Lee ..... B01D 19/0052 96/214
5,100,295 A * 3/1992 Madden ..... B01F 27/111 416/175
5,368,438 A * 11/1994 Raible ..... A61M 60/825 415/230
5,520,506 A 5/1996 Luthi
8,657,564 B2 2/2014 Cuppetelli
10,029,222 B2 7/2018 Van-De-Velde et al.
2009/0304501 A1* 12/2009 Dickertmann ..... F04D 29/167 415/208.1
2011/0008153 A1* 1/2011 Kato ..... F04D 13/06 415/143
2013/0121811 A1* 5/2013 Cuppetelli ..... F04D 29/2288 415/121.1
2016/0097400 A1* 4/2016 Stoicescu ..... F04D 29/2277 415/55.2
2017/0097008 A1* 4/2017 Doll ..... F04D 29/4206
2017/0241421 A1* 8/2017 Markovitch ..... E21B 43/128
2019/0345955 A1* 11/2019 DeClerck ..... F04D 1/025

FOREIGN PATENT DOCUMENTS

CN 105736400 A1 7/2016
WO WO 12/2021
PCT/CA2020/050902

OTHER PUBLICATIONS

Guenther et al., U.S. Appl. No. 62/868,093, filed Jun. 28, 2019, titled "Inducer for a Submersible Pump for Pumping Media Containing Solids and Viscous Fluids and Method of Manufacturing Same", 56 pages.
Gulich, "Centrifugal Pumps", Second Edition, 2010, Germany, pp. 401-411.

* cited by examiner

INDUCER FOR A SUBMERSIBLE PUMP FOR PUMPING A SLURRY CONTAINING SOLIDS AND VISCOUS FLUIDS AND METHOD OF DESIGNING SAME

FIELD

The present disclosure relates to inducers for submersible pumps; in particular, the present disclosure relates to inducers for submersible pumps for pumping a slurry containing solids and viscous fluids, and a method of designing such inducers.

BACKGROUND

An inducer is a rotating component on a centrifugal pump that lies outside of the volute casing and immediately upstream of the impeller. The purpose of inducers is primarily to reduce the required Net Positive Suction Head ("$NPSH_R$"), and thus reduce or prevent cavitation in the pump. There are two NPSH measures. The available NPSH ("$NPSH_A$") is a measure of the difference between the suction pressure (pressure at the inlet of the pump) and the vapour pressure of a fluid. Fluids have a vapour pressure at which point some of the fluid will evaporate, forming small air bubbles which will soon condense and implode back to liquid. This phenomenon is generally referred to as cavitation. It is desirable to reduce or eliminate cavitation, as it may worsen the performance of pumps when it occurs, as well as significantly wear out and damage the pump components where cavitation occurs. $NPSH_R$ is used to identify at what $NPSH_A$ or inlet suction pressure enough cavitation is present in the pump such that the performance of the pump is measurably affected. For example, by some standards, when the head produced by a pump drops by 3%, the $NPSH_A$ at that point is considered the $NPSH_R$. The 3% lower head will be compared to the head at higher $NPSH_A$. Typically, the head will remain constant at $NPSH_A$ higher than that point. It thus is important to ensure that the $NPSH_A$ in any application is equal to or above the $NPSH_R$. That is, the pressure of the fluid that will be pumped must be at least as high as the $NPSH_R$ at the suction inlet of the pump. $NPSH_R$ is based on the pump, whereas the $NPSH_A$ is based on the system that the pump will be placed in.

The purpose of an impeller in a centrifugal pump is to increase the pressure of the fluid from the inlet to outlet. However, the pressure typically drops sharply at the leading edge of the impeller blades before increasing. This is usually where cavitation occurs, but it can occur elsewhere in the impeller where a pressure drop occurs. Inducers reduce $NPSH_R$ by increasing the pressure upstream of the impeller. Inducers do this by accelerating the flow of the slurry more gently at the leading edges of the impeller blades, which reduces the possibility of cavitation occurring there. Throughout the inducer, the pressure rises gradually so that the pressure at the outlet of the inducer and inlet of the impeller is higher than it would otherwise have been without the inducer. The pressure drop at the impeller blades' leading edges will still occur, but since the pressure is already higher to begin with, there is less chance of cavitation occurring.

The inducers shown in FIGS. 1A and 1B are typical examples of inducers designed according to theory, which is based on pumps for operation in water or similar fluid systems. According to "Centrifugal Pumps" by Gulich (2010), a textbook on centrifugal pump design, the ideal design has small blade inlet angles ($\beta_1$), thin blades especially at the leading edge of the blade, and long channels; that is, the fluid will flow a relatively long distance between the inlet and outlet ends of the inducer. Both inducers shown in FIGS. 1A and 1B exhibit features of typical, theoretically ideal inducers. FIG. 1A shows a theoretically more ideal inducer, where the inlet angle $\beta_1$ of the blade at the bottom of the inducer is low (approximately 20°), whereas the inlet angle $\beta_1$ is much higher (approximately 50°) in the theoretically less ideal inducer illustrated at FIG. 1B. It may be observed that the channel or passageway in-between the inducer blades is much longer in FIG. 1A as compared to FIG. 1B, as the fluid will have to travel a longer distance to go from the inlet to the outlet of the inducer. The inducers shown in FIGS. 1A and 1B also have very thin blades.

A typical inducer for a submersible centrifugal pump, in the applicant's experience, cannot pump high-viscosity slurries, including but not limited to slurries comprising abrasive solids and/or relatively large solids, without experiencing performance degradation. An example of a highly viscous slurry, without intending to be limiting, includes mature fine tailings settled at the bottom of a tailings pond from an oil sands mining operation. Such slurry may comprise of water, bitumen, fine particulates, sand, rocks and other debris, such as trees and tree parts, which may enter the tailings pond from the surrounding area. The viscosity of the slurry may be in the range of 15 centi-poise (cP) and solids content in the range of 37% solids by weight. Relatively large and abrasive solids, for example having a diameter in the range of 33 mm to 130 mm, tend to damage the inducer blades, especially when the blades are thin. With the abrasiveness and size of the solids in a viscous slurry of the type found in a mature fine tailings pond, the inducer blades of a typical inducer will break from impact or wear away at an accelerated rate, reducing the useful life of the inducer. Furthermore, typical inducer designs do not allow large solids to pass easily through the inducer, thereby clogging the pump inlet. Additionally, high acceleration of the viscous slurry fluid during pumping may cause flow separation of the highly viscous fluid, so that the fluid then separates and falls away from the pump impeller, in which case the highly viscous slurry fluid may not begin to flow at all. As such, there is a need for an inducer which may be utilized on a submersible pump for pumping highly viscous slurries which slurries may additionally contain large solids.

SUMMARY

The inducer according to one aspect of the present disclosure is designed to assist pumping of a viscous slurry, such as slurries, containing large solids. With a fast acceleration, a slurry comprising viscous fluids may not begin flowing at all, or the flow may separate from the impeller blades. The applicant realized that reducing acceleration at the impeller blades by smoothing out the velocity profile of the slurry from the leading edge of the inducer to the leading edge of the corresponding impeller, results in reducing the acceleration of the fluid at the leading edge of the impeller blades as the flow transitions between the closely adjacent inducer and impeller blades. As such, selecting inducer parameters that result in a smooth velocity profile of the slurry as it travels through the inducer and transitions to and through the impeller leads to an optimized inducer design capable of moving a highly viscous fluid, for example, mature fine tailings and/or heavy bitumen, through the pump.

Design limitations impacting the design of the inducer, dictated by the presence of large solids in a highly viscous slurry, may be taken into consideration during the inducer design and optimization process. For example, the space between the blades of the inducer, which form a plurality of channels through which the slurry flows through the inducer to the impeller, may be dimensioned so as to receive and allow the passage of the large solids. As used herein, the phrase "large solids" is defined relative to the size of the pump. For example, "large solids" may be considered to be solids that have a maximum diameter in the range of 50% to 150% larger than a calculated blade height for the impeller of a standard, non-slurry pump; such standard, non-slurry pumps being known to persons skilled in the art. As would be known to one skilled in the art, the height of an impeller blade is the distance between the hub side and shroud side of the blade at the trailing edge of the impeller, such as the impeller blade height H shown in FIG. 7 for a slurry pump designed in accordance with the present disclosure; the blade height (not shown) of the impeller blade of a standard, non-slurry pump would be measured in the same way. To put it another way, a ratio of the impeller blade height of a slurry pump designed to pass large solids to the impeller blade height of a standard, non-slurry pump is in the range of 1.5 to 2.5.

Because the slurry pump is designed around a defined maximum solid size which is considered large for the pump, based on the flow rate, head and rotational speed of the pump, the inducer designed for that slurry pump must be capable of passing a large solid with a diameter corresponding to the blade height of the slurry pump's impeller. In some cases, the phrase "a large solid with a diameter corresponding to the blade height of the slurry pump's impeller" means that the correspondence between the maximum diameter of the solid and the blade height of the slurry pump's impeller is 1:1, although in other cases, the maximum diameter of the solid size may be slightly less than the impeller blade height of the slurry pump (such as, without intending to be limiting, a 99:100 or a 98:100 correspondence between the maximum solid size diameter and the impeller blade height of the slurry pump).

An illustrative example of an inducer designed in accordance with the present disclosure, referred to herein as the Prototype Model 7 or "PM7" inducer, was designed for pumping a viscous slurry containing solids having a maximum diameter of 130 mm. In this particular example, the impeller blade height is also 130 mm. However, it will be appreciated by a person skilled in the art that a solid having a maximum diameter of 130 mm is meant as an illustrative example only of what is meant by a "large solid" and is not intended to be limiting, and that the combination of a pump and inducer may be designed for passing solids having diameters of less than or greater than 130 mm.

In some embodiments of the present disclosure, matching the number of inducer blades to a corresponding number of impeller blades and aligning the trailing edge of each inducer blade with a leading edge of a corresponding impeller blade may enable or facilitate large solids to flow from the inducer to the impeller without being blocked by the leading edge of the impeller blades. Whereas, with conventional centrifugal pump configurations that include an inducer, the impeller may typically have a greater number of blades than the inducer. For example, radial impellers for centrifugal pumps may typically have five to seven blades, and sometimes as few as three blades or as many as nine blades; whereas, an inducer may typically have two to four blades.

In what follows, the term "axial direction" is intended to refer to a direction that is parallel to the axis of rotation of the drive shaft of the pump, and the term "radial direction" is intended to refer to a direction that extends radially outwardly from the axis of rotation and perpendicular to the axial direction.

The axial length of the inducer, defined below as length L and measured between the leading and trailing edges of the inducer blades, is preferably relatively short in highly viscous slurry applications, so as to reduce drive shaft deflection and limit the increased power draw of the pump. For some pump configurations, the axial length may also need to be limited to provide sufficient space for additional pump elements upstream of the inducer inlet, such as a cutting mechanism for reducing the size of the solids entering the inlet.

Furthermore, when integrating the inducer into a submersible pump for optimizing the inducer and impeller combination, the applicant discovered that reducing the gap or distance between the inducer blades and the corresponding impeller blades tends to reduce the acceleration of the slurry that may otherwise occur at the leading edges of the impeller blades, thereby assisting in maintaining a relatively smooth velocity profile as the slurry passes from the inducer to the impeller. Whereas conventional inducers, such as shown in FIG. 1C, may be mounted so as to be positioned entirely below the leading edges of the impeller blades, in one aspect of the present disclosure the inducer is coupled to the impeller so as to be partially nested within the impeller, thereby reducing the gap between the channels of the inducer and the channels of the impeller as compared to a typical inducer/impeller arrangement.

Other aspects of the inducer of the present disclosure may also depart from the theory for designing typical inducers for submersible fluid pumps. For example, in some embodiments of the present disclosure, the inlet angle of the leading edge of the inducer blade is larger than is theoretically called for in an ideal inducer, so as to enlarge the resulting fluid channels of the inducer to accommodate large solids and/or to accommodate the diameter of the inducer. As well, conventional inducers, to applicant's knowledge, include inducer blades having a backwards sweep, as defined below, at the leading edge; for example, in the range of 65° to 90°. In some embodiments of the present disclosure, the inducer blades sweep back at a smaller angle, such as in the range of 25°, to provide sufficient clearance to pass the required maximum solid size specified for the pump.

In one aspect of the present disclosure, an inducer for a submersible slurry pump is configured to pump a slurry containing large solids and viscous fluids. The pump includes an impeller having an impeller blade height, and the solids have a maximum diameter equal to the impeller blade height of the pump. The inducer is configured to be positioned within the pump's casing and mountable to a drive shaft of the pump, so that the inducer is adjacent to and immediately upstream of the impeller mounted on the drive shaft, and the inducer and the impeller are rotated on the drive shaft in a direction of rotation. The inducer comprises: a hub; at least two and no more than four inducer blades mounted to and extending axially along the hub, wherein the inducer blades extend outwardly from and wrap helically around the hub, the hub and the inducer blades thereby defining a plurality of channels. Each channel of the plurality of channels is bounded by the hub, the inducer blades, a plurality of impeller blades and an inner surface of the casing. A trailing edge of each blade of the inducer blades is configured so as to be positioned snugly adjacent to and in fluidical alignment with a leading edge of each corresponding blade of a plurality of impeller blades of the impeller when the inducer is mounted on the drive shaft of the pump, such that a velocity curve of the slurry is substantially smooth as the slurry travels from a leading edge of the inducer blades to the leading edge of the plurality of impeller blades.

In another aspect of the present disclosure, a submersible slurry pump is configured to pump a slurry containing solids and viscous fluids. The pump comprises: the inducer described in the paragraph above, which inducer is mounted on a drive shaft of the pump; an impeller mounted on the drive shaft downstream of and snugly adjacent to the inducer, the impeller having an impeller blade height; and a casing of the pump, the casing housing the inducer and the impeller. A trailing edge of each blade of the inducer blades is positioned snugly adjacent to and in fluidical alignment with a leading edge of a corresponding impeller blade of a plurality of impeller blades of the impeller when the inducer is mounted on the drive shaft, thereby defining a radial gap between the two, radial relative to the drive shaft, such that a velocity curve of the slurry is substantially smooth as the slurry travels from a leading edge of the inducer blades to and over the leading edge of the plurality of impeller blades. A maximum diameter of the solids is equal to the impeller blade height.

Additionally, a method for designing an inducer for a submersible slurry pump is provided. The submersible slurry pump is designed to pump a slurry containing solids in the range of 50% to 150% larger than a typical blade height for an impeller of a standard, non-slurry pump. The method includes the steps of:

a) identifying a group of constraints, the group of constraints including: a maximum solid diameter to be passed through the pump; a suction diameter of the pump; a diameter of a leading edge of the impeller of the pump; and a shaft size of a shaft passing through the inducer;
b) determining an initial group of primary parameters of the inducer based on theory for designing inducers of ideal submersible liquid pumps and constrained by the group of constraints; and
c) determining an initial group of secondary parameters of the inducer, based on theory for designing inducers of ideal submersible liquid pumps and constrained by the initial group of primary parameters and the group of constraints.

A resulting inducer, designed according to the initial groups of primary and secondary parameters, produces a smooth velocity curve of the slurry from the leading edge of the inducer to the corresponding leading edge of the impeller. In some embodiments, the resulting inducer also produces a substantially flat velocity curve of the slurry as the slurry travels from the leading edge of the inducer to the corresponding leading edge of the impeller of the pump.

In another aspect of the present disclosure, a plurality of preliminary inducer designs obtained by following the steps of the method described above may each be simulated, and at least one preliminary inducer of the plurality of preliminary inducers which produces a substantially smooth (and, in some cases, also substantially flat) velocity curve, as the slurry moves from the leading edge of the inducer to the leading edge of the impeller, is selected for further optimization.

The optimization steps may include:

a) modifying one or more parameters of the initial group of secondary parameters of the selected preliminary inducer to generate at least one modified inducer; and
b) repeating the simulations described above to simulate the at least one modified simulation inducer.

Optimization may also involve modifying one or more parameters of the initial group of primary parameters, in the optimization step (a) described above.

The initial group of primary parameters may include: a hub diameter of the inducer; an outer diameter of an inducer blade of the inducer; an inlet angle of the inducer blade; an outlet angle of the inducer blade. The initial group of primary parameters may further include a range for a blade chord length of the inducer blade at the shroud side. The initial group of secondary parameters may include: a number of blades of the inducer; a wrap angle of the inducer blade from a leading edge to a trailing edge of the inducer blade; a progression of a blade angle of the inducer blade from the leading edge to the trailing edge of the inducer blade; a chord length of the inducer blade; a sweep angle of the inducer blade; an axial tapering of the leading edge or the trailing edge of the inducer blade; a trim of the leading edge or the trailing edge of the inducer blade towards a shroud side of the inducer blade. The secondary parameter of the number of inducer blades may be determined so as to equal the number of impeller blades of the pump's impeller.

DETAILED DESCRIPTION

Figure 13A:
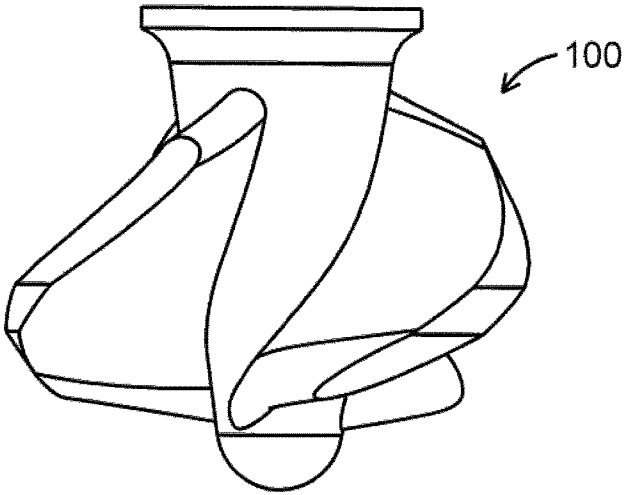
FIGS. 13A and 13B are front and top profile views, respectively, of a further embodiment of an inducer in accordance with the present disclosure.
Figure 13B:
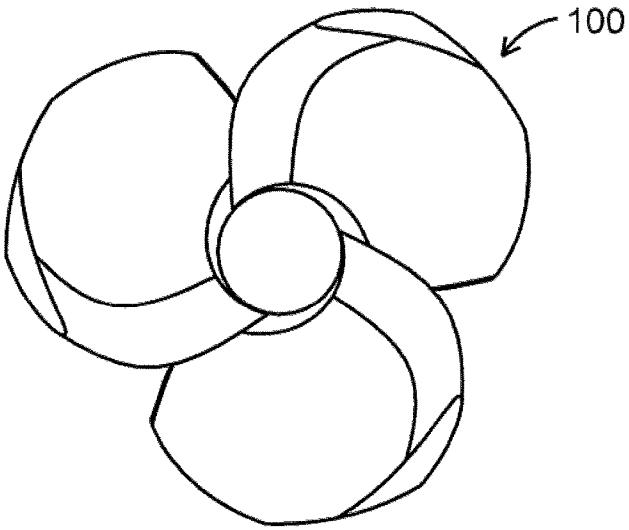
Figure 14A:
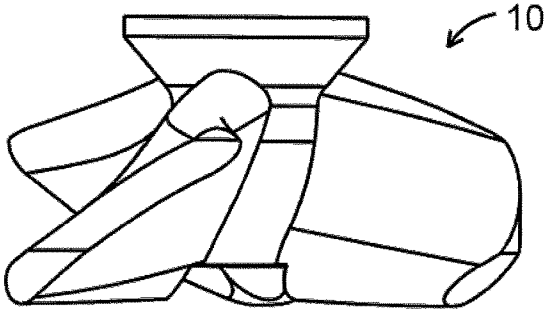
FIGS. 14A and 14B are front and top profile views, respectively, of the inducer of FIG. 2.
Figure 14B:
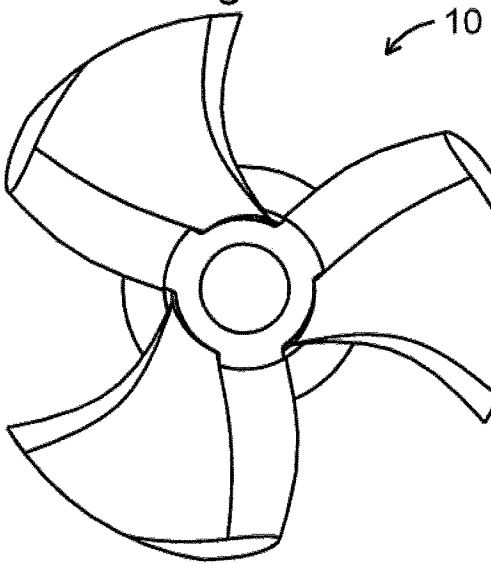

In one aspect of the present disclosure, and by way of example and without intending to be limiting, an inducer, referred to herein as the "PM7 inducer", is described for a 600 horsepower (hp) slurry pump with a semi-open impeller, for pumping high viscosity slurries with solids up to 130 mm in diameter. For example, without intending to be limiting, such high viscosity slurries may be found at the bottom of a tailings pond of an oil sands production site, wherein the high viscosity slurry comprises water, bitumen, sand, silt, rocks and other debris, such as trees and tree parts, that may enter the tailings pond from the surrounding area. The viscosity of such a slurry may be in the range of 15 cP and may have a solids content in the range of 37% solids by weight. However, it will be appreciated by a person skilled in the art that the PM7 inducer is provided herein as an illustrative example only, and is not intended to be limiting. A further example of an inducer 100, referred to herein as the Prototype Model 1 or "PM1" inducer, illustrated in FIGS. 13A and 13B, was designed in accordance with different constraints, such as for different maximum solid sizes and for a different pump than the constraints for which the PM7 inducer was designed. As can be seen in FIGS. 13A and 13B, showing front and top elevation views of the PM1 inducer 100, as compared to the front and top elevation views of the PM7 inducer 10 shown in FIGS. 14A and 14B, the specific features or parameters of each inducer may be different, but are still within the scope of the present disclosure of inducers designed for pumping slurries comprised of viscous fluids and large solids. For ease of comparison, the PM1 inducer 100 is shown at a scale of 1.719 in FIGS. 13A and 13B whereas the PM7 inducer 10 is shown at a scale of 0.500, such that the outer diameter of the inducer blades appears the same.

Although the specific examples of the PM7 and PM1 inducers are described herein to illustrate different aspects of the present disclosure, it will be appreciated by a person skilled in the art that the disclosure is not intended to be limited to the characteristics of the PM7 or PM1 inducers or to the operating requirements for which the PM7 or PM1 inducers were designed. Inducers for other submersible slurry pumps, designed to pump slurries of different viscosities and containing large solids having a range of maximum diameters, are within the scope of the present disclosure.

As such, one of the design goals for the present inducers disclosed herein was to assist with getting the highly viscous slurry fluid to flow effectively and efficiently through the slurry pump, inhibiting separation of the slurry fluid flow from the inducer and impeller blades of the pump. With a fast acceleration, fluids with high viscosity may not begin flowing at all, or may separate and fall away from the blades; for this reason, inducing a slower, gentler acceleration of the slurry fluid upstream of the impeller is preferable. In the absence of an inducer, high acceleration of the viscous slurry will occur on the impeller blades. Another design goal of the inducer disclosed herein was to reduce the $NPSH_R$, since there may be low pressures at the suction end of the inducer, and large slurry pumps will tend to cavitate more readily in such conditions.

Figure 1B:
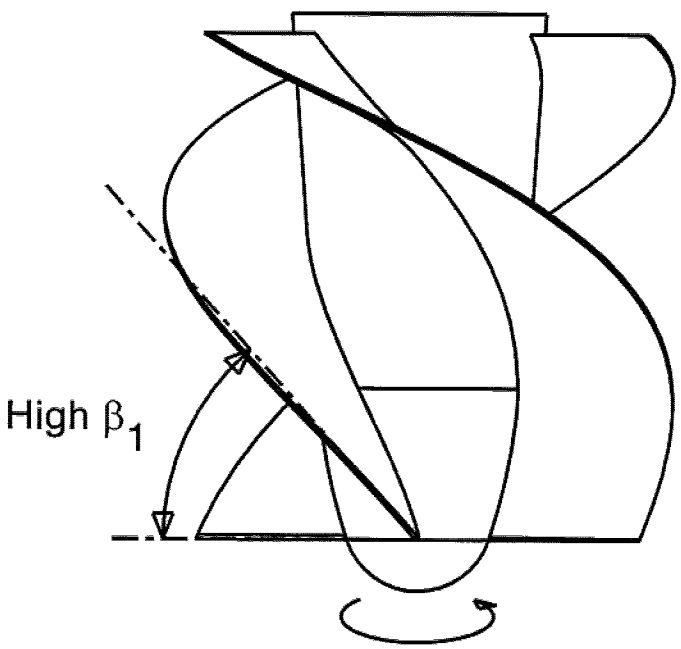
Fig. 1B (prior art)
FIG. 1B is a side profile view of a second example of a prior art inducer.
Figure 1A:
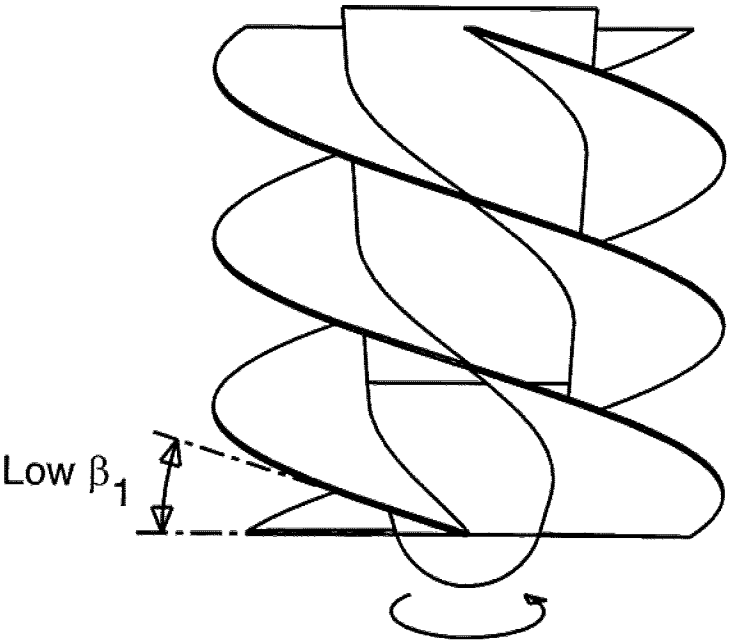
Fig. 1A (prior art)
FIG. 1A is a side profile view of a first example of a prior art inducer.

The pumping environment and nature of the slurry thereby necessitates implementing certain design limitations that are, in applicant's opinion, counterintuitive when taking into consideration the theoretical design parameters of a typical or ideal inducer. For example, the inducer blades had to be much thicker on the present inducers than on a typical inducer in order to handle the abrasive solids being passed. With the abrasiveness and size of the solid material, thin blades would break from impact and/or wear away quickly. An embodiment of the inducer, the PM7 inducer discussed herein, is designed to receive and pass through large solids to the impeller, the solids having a diameter of up to 130 mm, without clogging the inducer or suction of the pump. With reference to FIGS. 1A and 1B, it may be appreciated that the channels defined by the inducer blades of the inducer in FIG. 1A are generally smaller in size, as compared to the channels defined by the inducer blades of the inducer in FIG. 1B. This is due to the magnitude of the inlet angle $\beta_1$, which angle $\beta_1$ is smaller in FIG. 1A than in FIG. 1B. Therefore, a larger inlet angle, such as the larger inlet angle of the theoretically less-ideal inducer of FIG. 1B, may be required to provide for large enough channels between the inducer blades to receive relatively large, solids.

Figure 2:
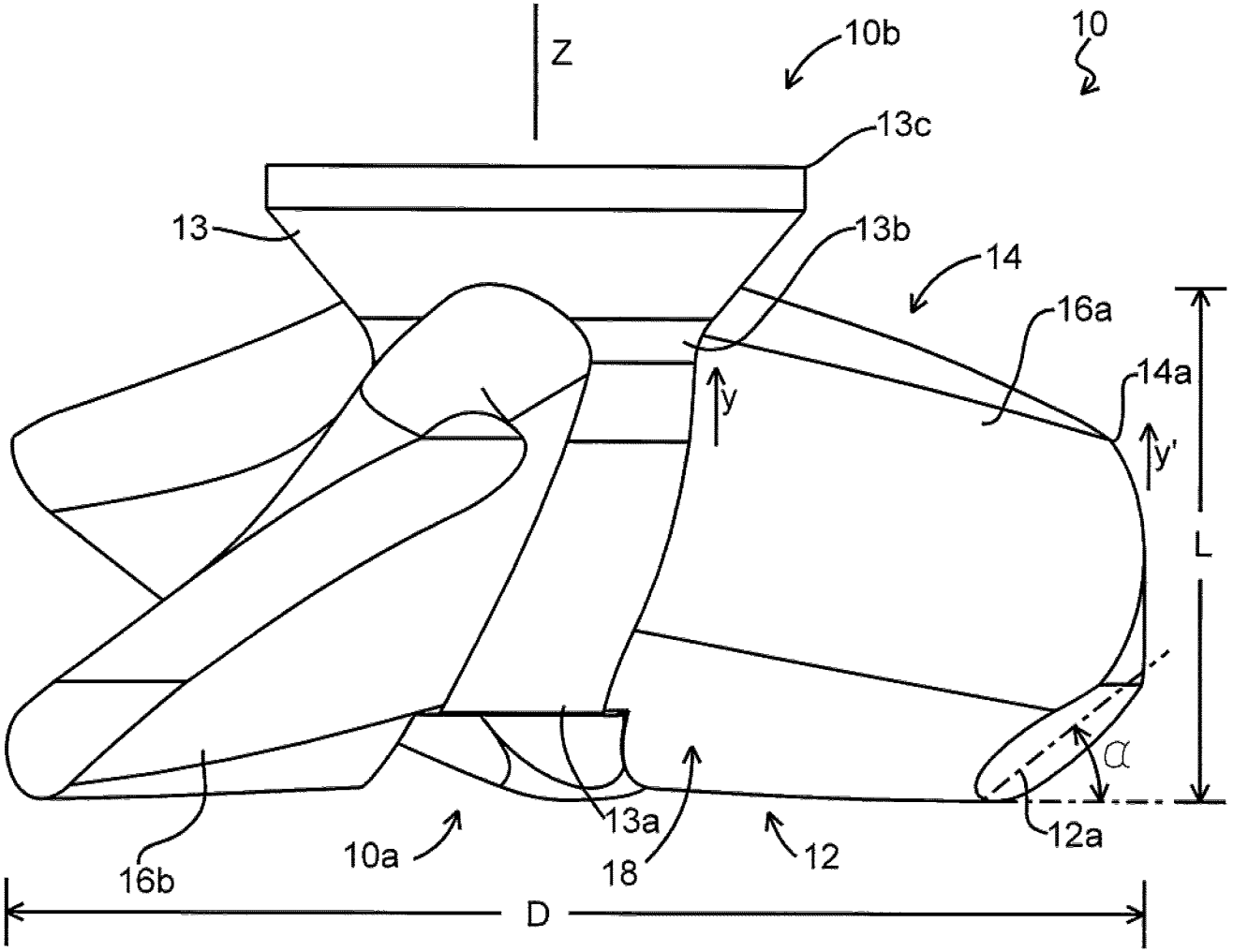
FIG. 2 is a side profile view of an embodiment of an inducer in accordance with the present disclosure.

Other design limitations for the inducer may include a limited or shortened axial length of the inducer L, as seen in FIG. 2, measured from the inlet to the outlet of the inducer blades, so as to provide sufficient space for additional components upstream of the inducer (for pump configurations that include such additional components). Specifically, upstream of the inducer there may be mounted a cutter which consists of a rotating component with two cutting blades and a stationary component with three stationary arms. Such a cutter would be known to one skilled in the art. In combination, these cutter components will help cut and reduce the size of large solids; in the present example of the PM7 inducer, so as to reduce their size to no larger than 130 mm. As such, the axial length L of the inducer was limited so as to ensure the casing inlet was positioned close to the ground, while still providing sufficient space for the cutter components.

Figure 4A:
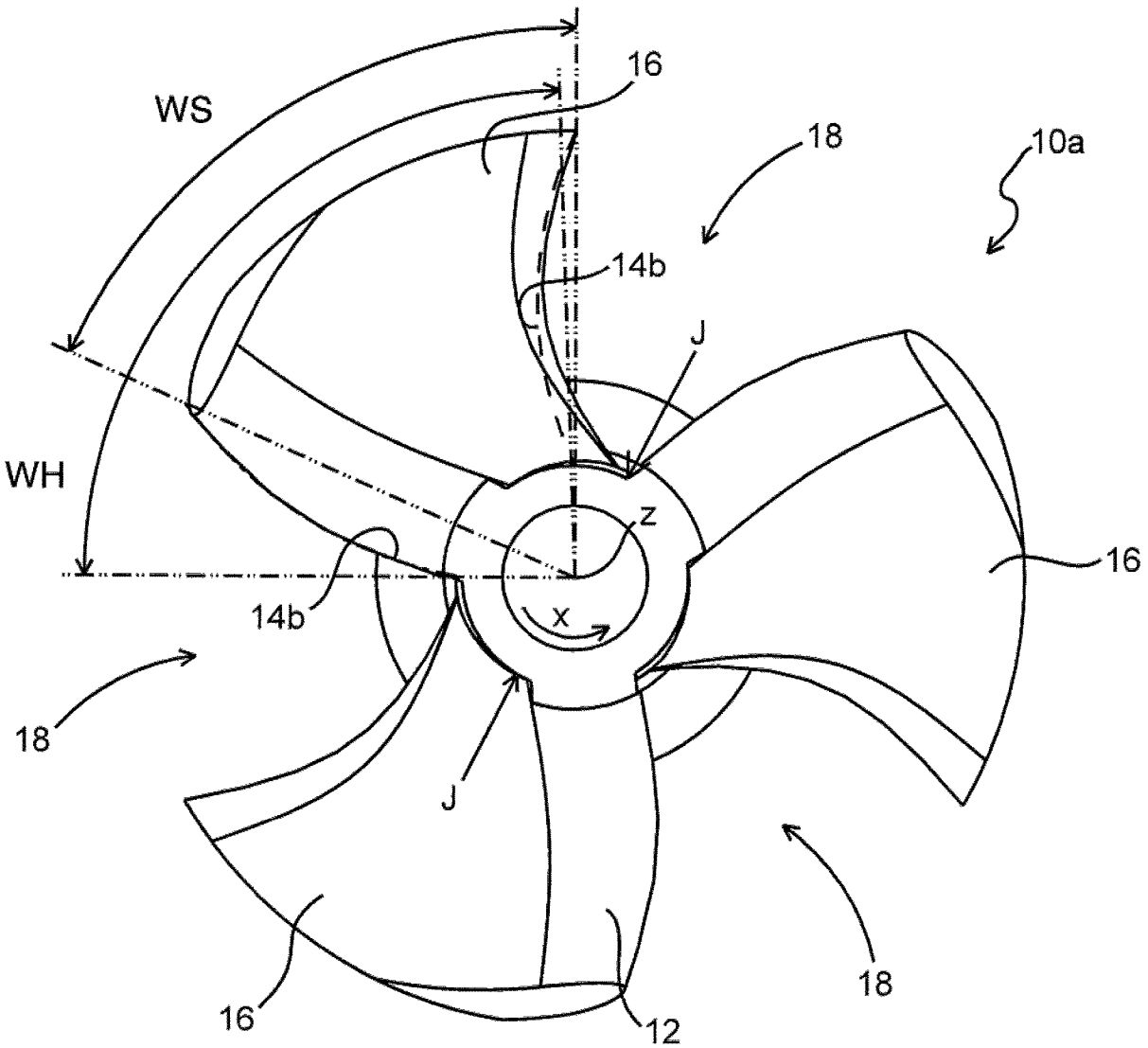
FIG. 4A is a profile view of the inlet end of the inducer of FIG. 2.
Figure 4B:
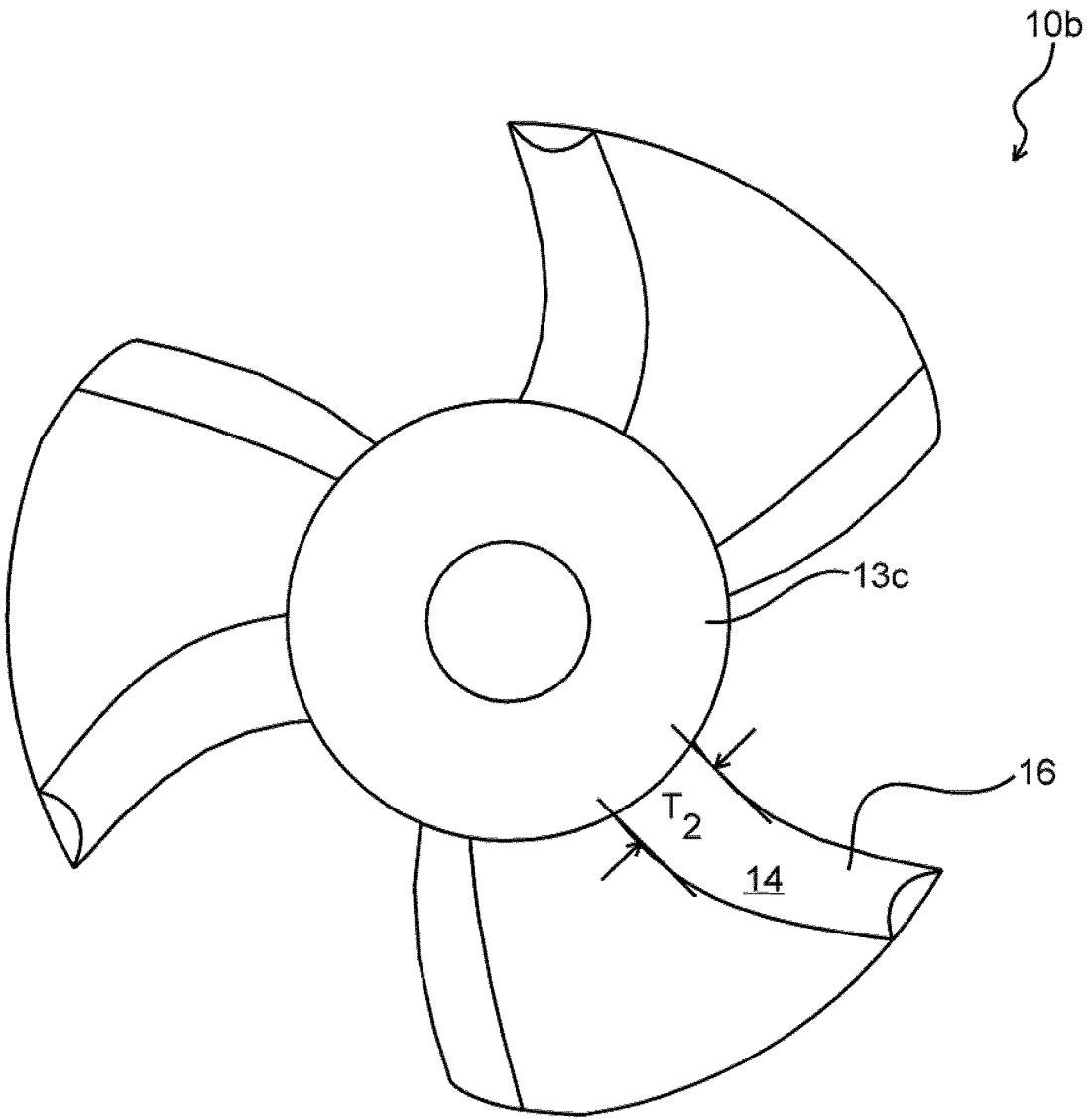
FIG. 4B is a profile view of the outlet end of the inducer of FIG. 2.

Additional considerations for limiting the axial length L of the inducer include limiting the increased resistance or drag acting on the inducer blades for an inducer having a longer axial length as compared to an inducer having a shorter axial length, as well as limiting the weight the inducer added to the system, thereby reducing the additional power draw that may be required by adding the inducer to the drive shaft and reducing the potential for bending or deflection of the drive shaft to occur. Without intending to be limiting, in the example of the PM7 inducer as shown in FIG. 2, the chord length of the inducer 10 at the shroud side is 226 mm and an outer diameter D of the inducer 10, best viewed for example in FIG. 4A, is approximately 357.5 mm, resulting in a chord length that is approximately 0.6 times the pitch of this inducer having three blades. In another example of a three-blade inducer designed in accordance with the present specification, the chord length measured at the shroud side is 82 mm while the outer diameter of the inducer is 104 mm, yielding a chord length that is approximately 0.75 times the pitch of this inducer example. In some embodiments, a chord-length-to-pitch ratio in the range of 0.6 to 0.8 for inducers designed in accordance with the present disclosure, is smaller than the chord-length-to-pitch ratio recommended for a typical inducer, which is normally in the range of 1.0 to 2.5, and ideally within the range of 1.5 to 1.8.

As previously mentioned, positioning the inducer near the impeller so as to reduce the gap between, and fluidically align, the inducer and the impeller, applicant has been found, plays a significant role in maintaining the pressure and velocity of the slurry as it flows from the outlet of the inducer to the inlet of the impeller across the gap between the inducer and the impeller. The term "gap" as used herein is defined as the location of, and the distance between, an inducer blade and a corresponding impeller blade where that distance is the smallest. Ideally, the gap between the inducer and impeller blades is reduced as much as reasonably possible while taking into account the spacing between the inducer and impeller required to allow for machining tolerances. For example, without intending to be limiting, the distance of the radial gap G, best viewed in FIGS. 3 and 6, between the trailing edge 14 of an inducer blade 16 and an inner surface 26*a* of an impeller blade 26 is approximately 5.5 mm. The distance of the radial gap G for the spacing between the inducer and the impeller may preferably be in the range between 3 mm and 6 mm.

In a conventional pump having an inducer, the number of blades of the inducer and the number of blades of the corresponding impeller may be different. For example, a typical impeller may have five to seven blades, while a typical inducer may have two to four blades. However, a pump configuration where the number of impeller blades differs from the number of inducer blades results in the trailing edge of at least some of the inducer blades not aligning with the leading edge of at least some of the inducer blades. For applications in which the slurry includes solids, the mismatch in the number of impeller blades and inducer blades may result in some solids becoming blocked as the slurry flows from the inducer to the impeller. Advantageously, matching the number of inducer blades to the number of impeller blades on an impeller and inducer mounted closely adjacent to one another on a common drive shaft may provide for nearly continuous channels between the inducer and impeller blades through which the slurry flows, thereby reducing the blockage of solids that may otherwise occur as the slurry flows through the inducer and impeller. For example, not intended to be limiting, in some embodiments the plurality of inducer blades consists of three blades 16 and three corresponding blades 26 on the impeller 20. However, it will be appreciated by a person skilled in the art that the same advantage may be realized, in other pump configurations, by matching the number of inducer blades to the number of corresponding impeller blades on the impeller of a given pump configuration, so long as the channels remain large enough to handle the anticipated solids. In another example, an impeller may have four blades and the corresponding inducer may have two blades, which configuration may still enable for alignment between the trailing edge of the inducer blades and the leading edge of two of the four blades of the corresponding impeller. It will further be appreciated that for slurry which does not include large solids, it may not be required to match the number of inducer blades to the number of impeller blades when designing the inducer.

In one aspect of the present disclosure, a number of design parameters for a new inducer designed to pump a slurry containing viscous fluids and large solids are determined, including the thickness of the blades, the length-to-diameter ratio and the size (diameter) of the hub of the inducer were defined. Then, one or more initial inducer designs featuring these design parameters were modelled utilizing software so as to obtain a performance baseline. An example of such modelling software, without intending to be limiting, includes the ANSYS™ Computational Fluid Dynamics software package (such modelling software referred to herein as the "CFD Software"). One or more of the initial inducers were modified and then modelled so as to assess the modified inducers' performance against the performance baseline. Performance of each of the modified inducers was assessed by plotting the average velocity of the fluid, from the inlet of the pump to the outlet of the impeller. Reductions in the velocity gradient or curve, so as to smooth and lessen or flatten the velocity gradient of the fluid flowing between the pump inlet and the outlet of the impeller, were observed by the applicant as an improvement over the baseline performance measurement, thereby identifying one or more of the modified inducers as an optimized new inducer design.

Furthermore, to determine the existence of, or an amount of, cavitation occurring in the pump, one or two methods may be utilized during the modelling process. Firstly, a standard method for determining cavitation in physical tests is to measure the head or pressure increase over a pump component at a specific inlet fluid pressure. That pressure of the fluid, as measured at the inlet, is then lowered until the head or pressure produced drops 3% from its baseline value. These tests may be replicated in the CFD Software to determine the inlet fluid pressure that would produce a 3% head drop. Once this inlet fluid pressure is determined, analysis of the amount of cavitation present involved running simulations on inducers at that inlet fluid pressure where cavitation occurs, then measuring the volume of air present. If the volume of air present was reduced in the presence of the inducer, $NPSH_R$ was improved. Another method that may be used for measuring cavitation is to maximize the head at the inlet fluid pressure previously determined to produce a 3% head drop. If the resulting head or pressure was found to be higher, one may deduce that less cavitation was occurring.

Simulations utilizing the CFD Software may be initially run with only the impeller and the pump casing to plot the velocity and assess the resulting velocity gradients (or in other words, the acceleration of the pumped fluid). The $NPSH_R$ may also be determined. With these baseline results, simulations were subsequently run with different versions of the inducer to determine whether the inducer produced a smooth, relatively flat velocity curve and/or reduced cavitation. If cavitation was reduced but not eliminated, the cavitation preferably occurs around the inducer and not in the impeller area, as the inducer is considered a sacrificial, or in other words, expendable, component of the pump, similar to the concept of a sacrificial anode, whereby cavitation, to the extent that it occurs, causes damage to the inducer that would otherwise occur at the impeller. Advantageously, to the extent that cavitation occurs and damages the inducer, in addition to damage to the inducer caused by impacts of the solids in the slurry, the inducer is generally smaller and less expensive to manufacture compared to the impeller, and also may be less labour intensive to replace as compared to the impeller. Thus, an inducer may extend the life of the impeller, and an inducer is also simpler and less expensive to replace as compared to replacement of the impeller.

In response to the results obtained from the initial simulations, modifications may be made to one or more parameters of the inducer and then further simulations may be run to determine whether the modifications produced improved results, such as a smoother, flatter velocity curve and/or reduced cavitation. A number of further design parameters, in addition to those mentioned above, may be used to define and modify the shape and design of the inducer. Such parameters, defined below, may include in particular: the inlet and outlet angles of the inducer blades, measured at the inducer hub and at the outer diameter of the inducer blades; the wrap angle of the inducer blades at the hub and at the outer diameter of the inducer blades; the sweep of the leading edge of the blades; and the shape of the leading and trailing edges of the blades when viewed from the side profile of the inducer.

The shape of the leading and trailing edges of the inducer blades may be defined radially, such as having a straight edge, or having a convex or concave shape relative to the direction of rotation X (as seen in the PM7 inducer illustrated in FIG. 4A). The shape of the leading and trailing edges of the inducer blades may also be defined axially; that is, when observed from a side profile view of the inducer, the leading or trailing edge of the inducer blade may be substantially radial and straight, or it may be curved. The leading or trailing edge, at the free edge of the blades distal from the hub, may extend axially towards the inlet or outlet ends of the inducer. Furthermore, the leading or trailing edges of the inducer blades may be axially curved. In other words, the leading edge or trailing edge of the inducer blade may have a variable axial location with respect to the radius of the blade as measured from the hub to the shroud side of the blade. For example, a leading edge of an inducer blade may be curved towards the shroud layer of the blade, such that the blade's leading edge at the shroud is axially farther back from the direction of flow than the blade's leading edge at the hub, which flow will travel from the leading edge to the trailing edge of the inducer. At the trailing edge, the blade is straight and the hub layer extends axially farther back with respect to the direction of flow, as compared to the shroud layer. The applicant has found that the trailing edge shape of the inducer blade may be an important parameter, as it may be modified so as to more closely match the shape of the inducer at the trailing edge to the leading edge of the impeller just downstream of the inducer, thereby bringing the trailing edge of the inducer closer to the leading edge of the impeller blade and thereby reducing the distance of the gap G.

The wrap angle defines the radial angle between the leading edge and trailing edge of a blade at a specific layer, such as the hub or shroud layers of the inducer blade. The term "hub layer", as used herein, refers to dimensions or characteristics of a blade as measured at the interface between the blade and the hub, while the term "shroud layer", as used herein, refers to dimensions or characteristics of a blade as measured at a free edge of the blade, distal from the hub, where the blade is adjacent the shroud or casing. It will be appreciated by a person skilled in the art that the term "shroud layer" may be used regardless of whether the inducer or the impeller actually has a shroud or not.

Typical inducers may have large wrap angles measured at the shroud layer, for example exceeding in the range of 180° to 400°. A wrap angle of 360°, measured at the shroud layer, for example, means that a single inducer blade wraps entirely around the hub of the inducer once. In contrast, examples of inducers designed in accordance with the present disclosure have comparatively small wrap angles. For example, the PM7 inducer has a wrap angle WS of 65° measured at the shroud layer, as shown in FIG. 4A providing a view of inducer 10 at the inlet or suction end 10*a*, and the PM1 inducer has a wrap angle of 74° measured at the shroud layer. Generally speaking, inducers designed in accordance with the present disclosure may have a wrap angle WS measured at the shroud layer, of less than 100°, in contrast to the shroud layer wrap angles of typical inducers which, as stated above, may typically range from 180° to 400°. A person skilled in the art will note that, in FIG. 4A, the reference lines 14*b*, represented as dashed lines, show the location of the trailing edge 14 of the blade 16, while the dash-dot lines are reference lines drawn from the axis of rotation Z to the original inner diameter J of the leading edge 12 and trailing edge 14 of the blades, and also from the axis of rotation Z to the outer diameter D of the leading edge 12 and trailing edge 14 of the blades, thereby defining the wrap angles WS and WH.

Figure 3:
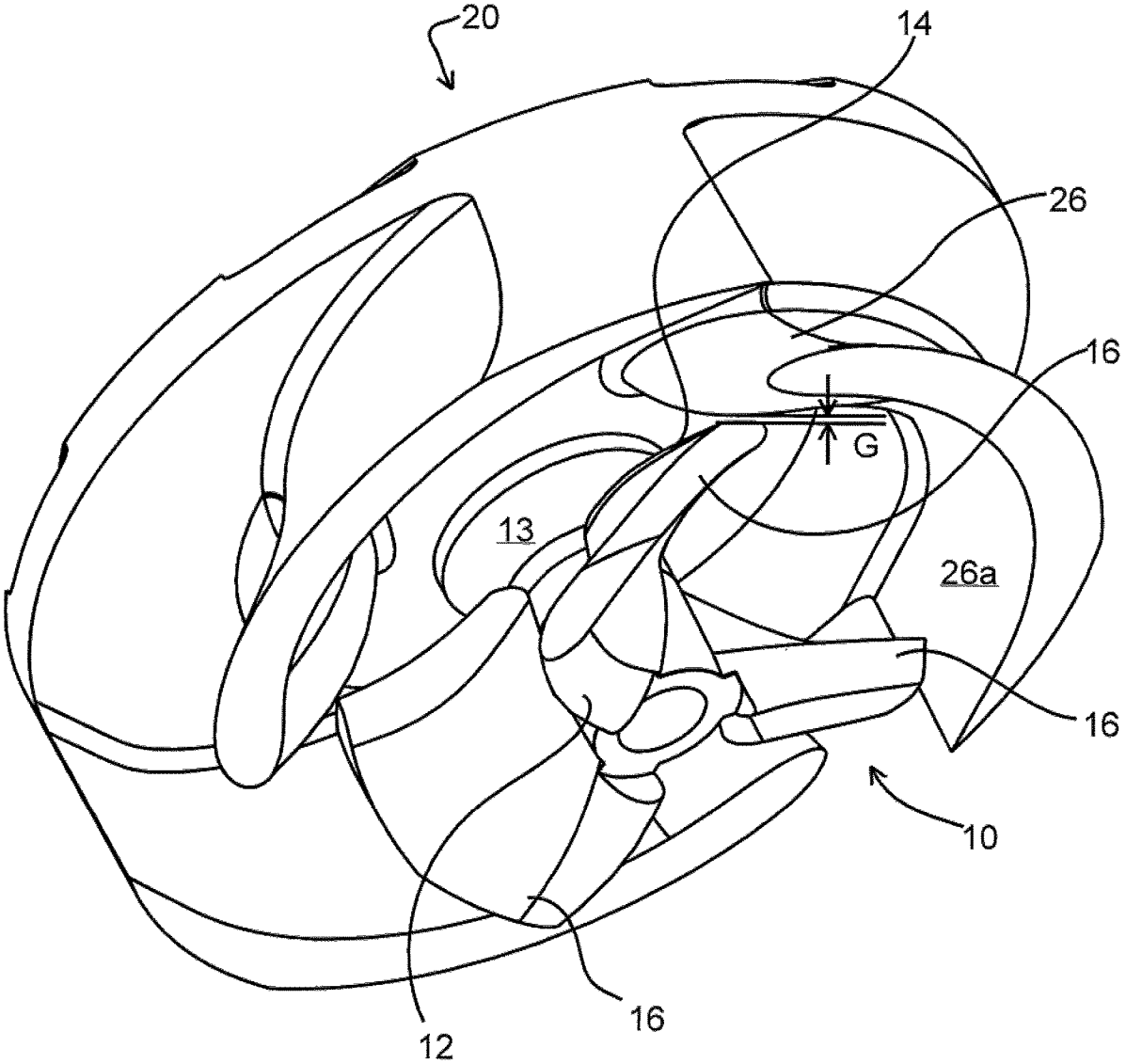
FIG. 3 is a close-up perspective view of a portion of the embodiment of the inducer of FIG. 2 arranged adjacent to an impeller.
Figure 4C:
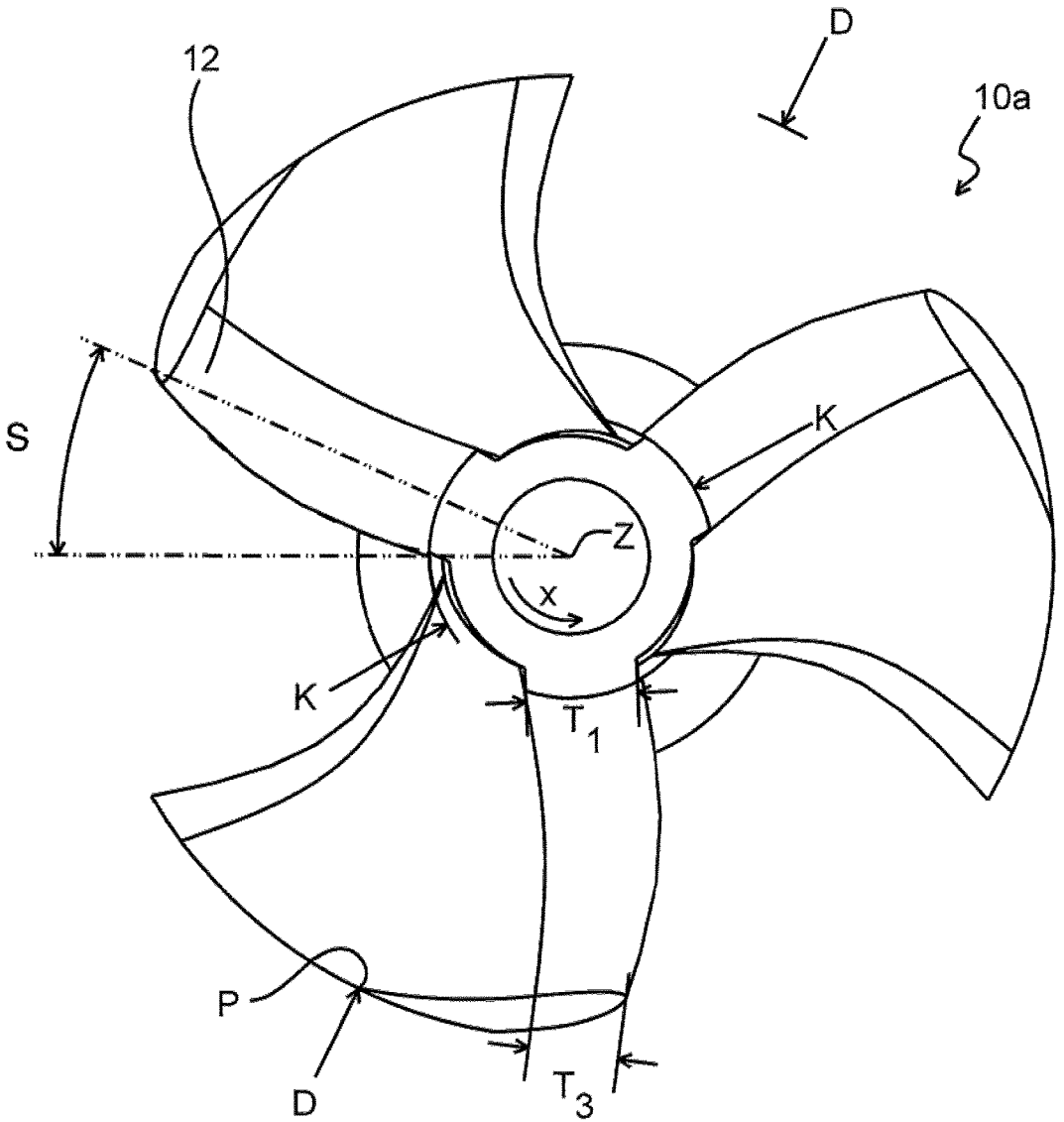
FIG. 4C is the same profile view of the inlet end of the inducer of FIG. 4A.
Figure 5A:
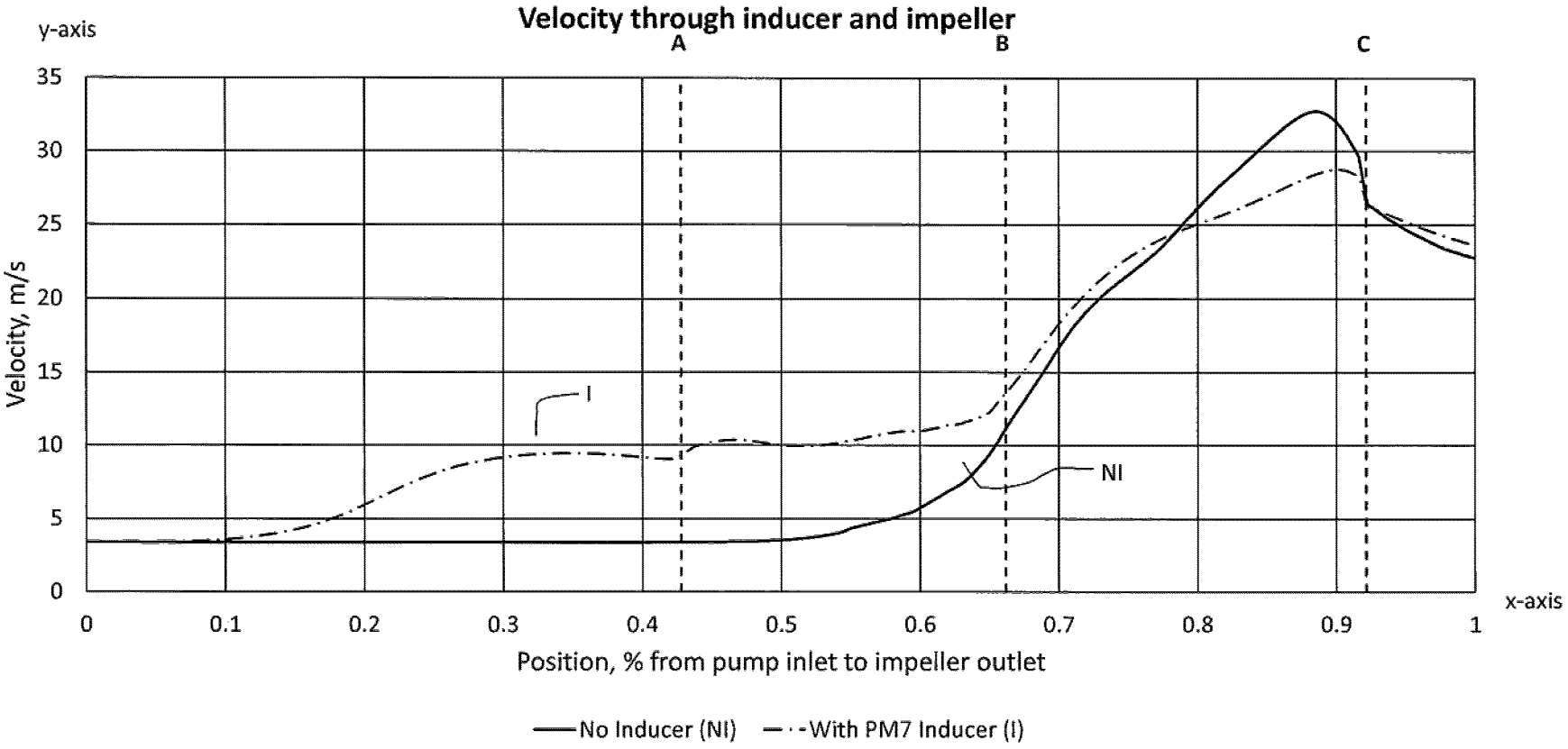
FIGS. 5A and 5B are line graphs showing the velocity of a pumped fluid as the fluid moves through two examples of an inducer and impeller of a pump in accordance with the present disclosure, compared against the velocity plot of a pumped fluid moving through a pump having an impeller alone.
Figure 6:
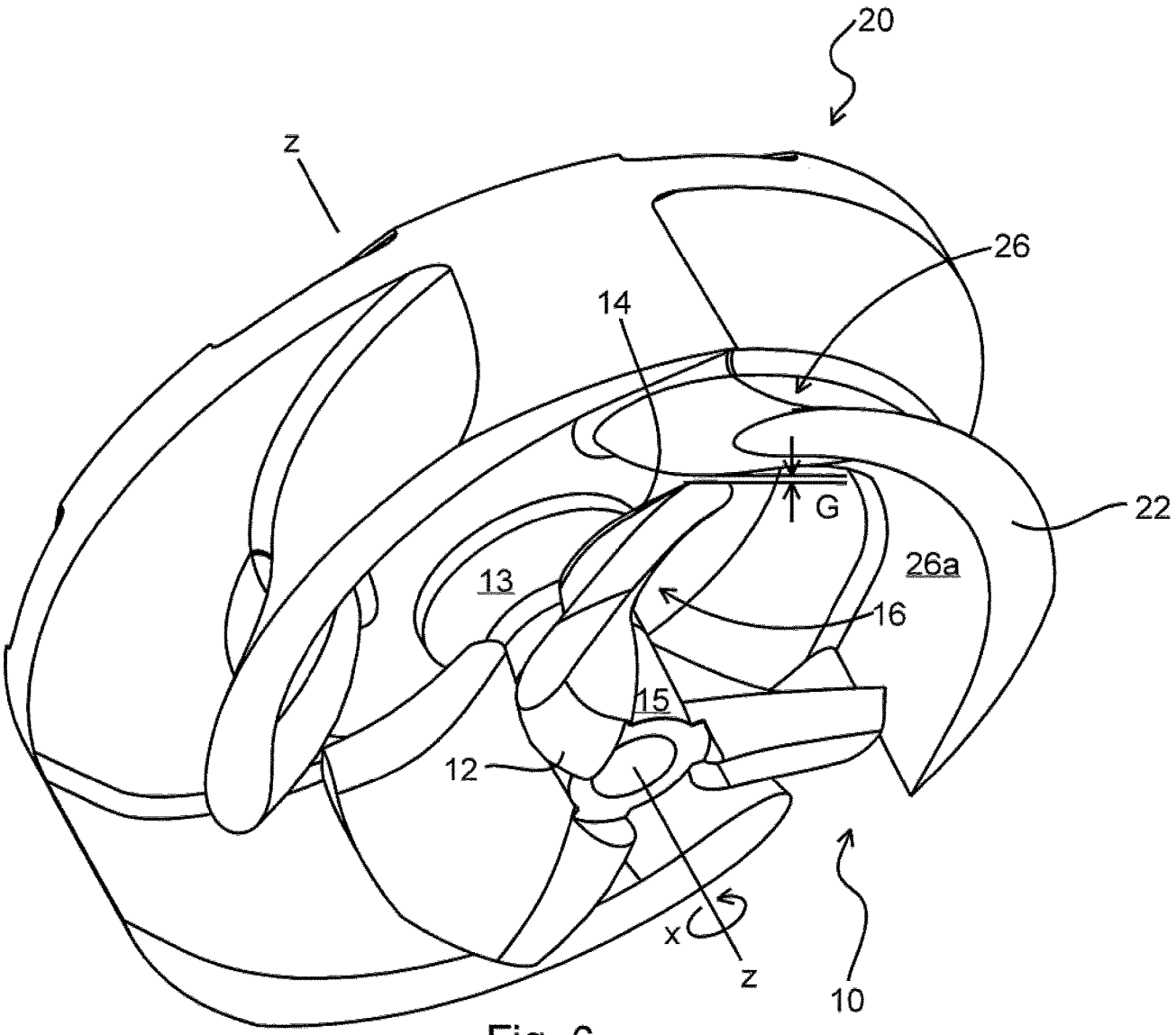
FIG. 6 is an additional perspective view of the inducer and impeller arrangement shown in FIG. 3.
Figure 7:
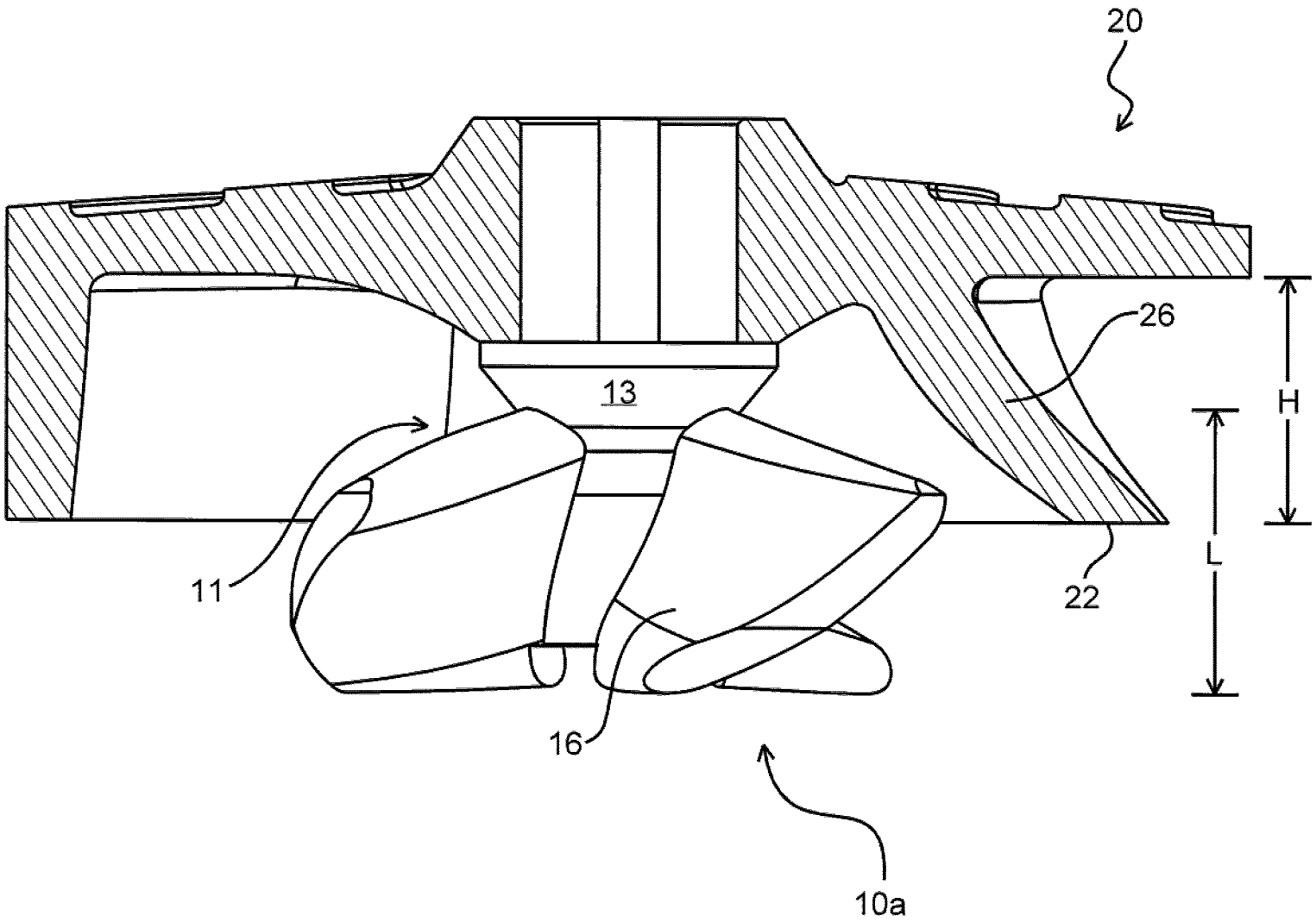
FIG. 7 is a side profile, partially cut-away view of the inducer and impeller arrangement shown in FIG. 3.
Figure 8A:
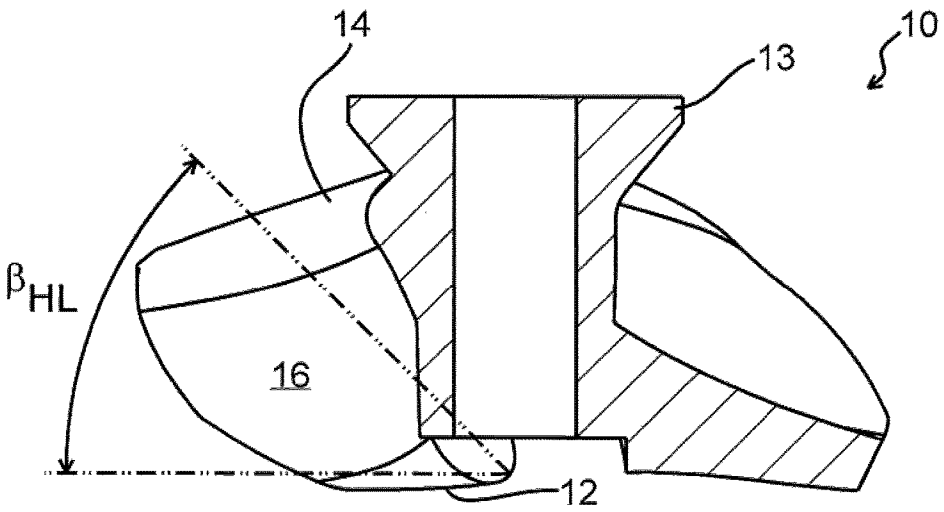
FIG. 8A is a partially cut away side profile view of the inducer shown in FIG. 2.
Figure 8B:
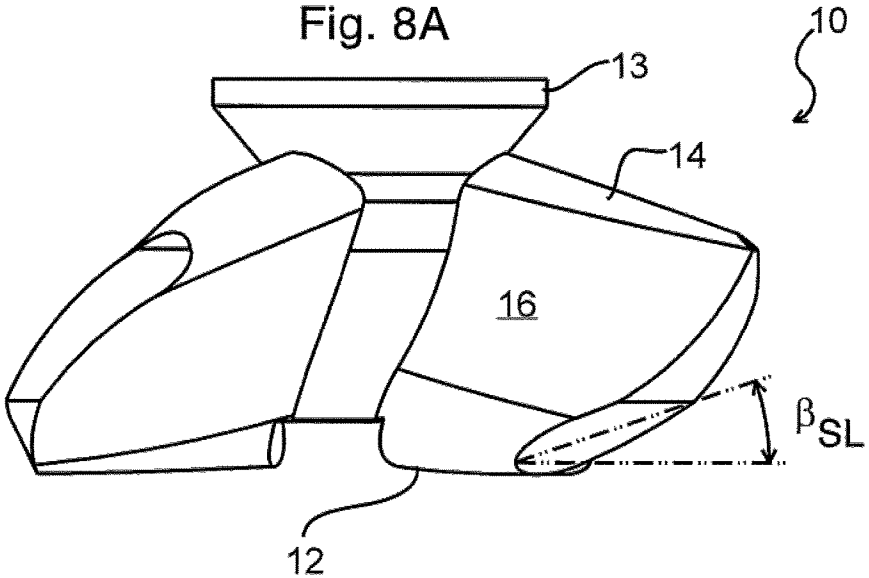
FIG. 8B is an additional side profile view of the inducer shown in FIG. 2.

An illustrative example of an inducer of the present disclosure, referred to herein as the PM7 inducer 10, is illustrated in FIGS. 2, 4A, 4B, 4C, 8A, 8B, 14A and 14B, while that same example of the PM7 inducer is illustrated coupled to a corresponding impeller 20 in FIGS. 3, 6 and 7. Simulation of a pump utilizing the inducer 10 demonstrated improved acceleration performance of the pump. For example, FIG. 5A is a line graph plotting the velocity (m/s) of the slurry as it flows through the inducer PM7 and corresponding impeller of the pump, as measured during a simulation of the pump. The velocity of the slurry is plotted along the y-axis while the position of the slurry relative to the pump is plotted along the x-axis, starting at the inlet to the pump upstream of the inducer and ending outside, and a little downstream of, the impeller. The location of the leading edges of the inducer blades and the leading and trailing edges of the impeller blades are indicated by vertical lines A, B and C respectively along the x-axis. The solid line NI is a plot of the fluid velocity flowing through an impeller without the benefit of an inducer according to the present disclosure. The broken line I is a plot of the fluid velocity flowing through the same pump where an inducer according to the present disclosure is mounted closely upstream of the impeller and positioned so that the trailing edge of each blade of the inducer blades is snugly adjacent to and in fluidical alignment with a leading edge of each corresponding blade of a plurality of impeller blades of the impeller.

As may be seen in FIG. 5A, the velocity plot NI for the pump without an inducer shows a relatively sharp increase in velocity, corresponding to high acceleration, immediately upstream of the impeller. This relatively high acceleration of the pumped fluid will tend to cause the viscous fluid to separate, and thereby not flow effectively or at all through the pump. The velocity plot I for the pump incorporating the inducer disclosed herein illustrates that the flow velocity starts to increase more gradually, and at a position further from the impeller and upstream of the inducer, which is caused in part by the synergistic effect between the closely aligned and adjacent placement of the inducer relative to the impeller. The velocity plot I of the pump incorporating the inducer is relatively smooth and flat between lines A and B, indicating small fluctuations or no acceleration of the pumped fluid as it flows between the inducer and the impeller. The term "flat" is used herein in the sense of referring to a smooth velocity gradient, thereby indicating a smooth and slow increase in velocity.

Additionally, the velocity gradient does not increase greatly prior to entering the inducer, where the viscous fluid will flow better because it is in contact with the inducer blades. In comparison, the solid line velocity plot NI for the pump without an inducer, illustrates a significant increase in velocity approaching (ie: upstream of) the leading edge of the impeller (line B). Whereas, in the pump incorporating the inducer, the velocity of the pumped fluid remains relatively constant as it flows between the leading edges of the inducer and the impeller, with only a slight increase in velocity as the fluid moves past the leading edges of each of the inducer and the impeller. It may also be seen that the velocity of the fluid increases gradually between entering the inlet of the pump (line AA) and before it reaches the leading edge of the inducer (line A), for the pump including the inducer, whereas the velocity of the fluid remains constant before sharply increasing as it approaches the leading edge of the impeller (line B), in the pump without an inducer. Further, in the pump without an inducer, the velocity profile spikes, at the trailing edge of the impeller (line C), and to a higher velocity as compared to the pump with the inducer.

Figure 5B:
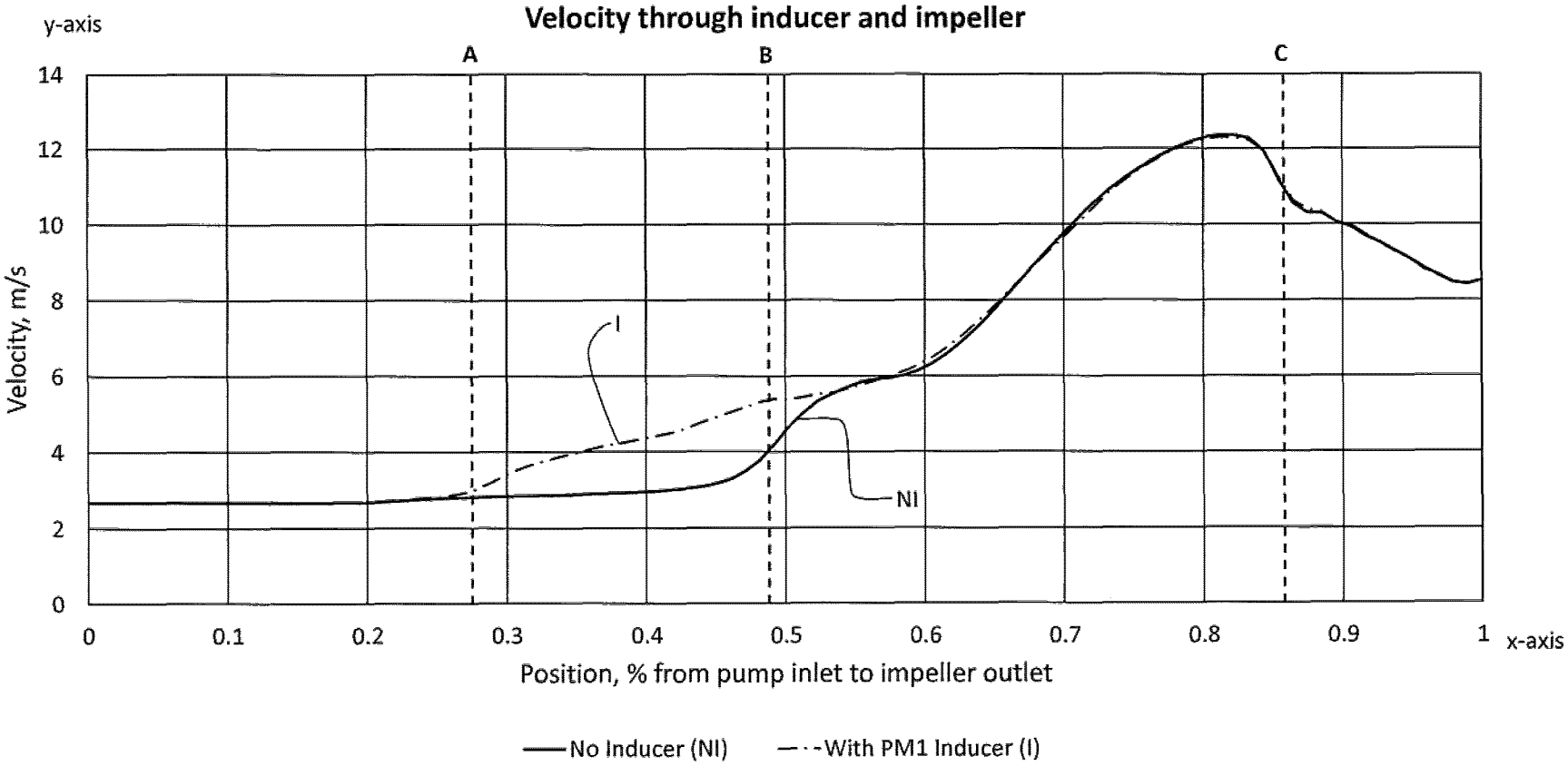

Similar features are illustrated in FIG. 5B, which is a line graph plotting the velocity (m/s) of the slurry as it flows through another example of an inducer PM1 designed in accordance with the present disclosure and the corresponding impeller of the pump, as measured during a simulation of the pump with the inducer PM1 (in the velocity plot I of the pump featuring inducer PM1) as compared to the velocity plot NI of the pump without the inducer PM1. However, it can be seen in FIG. 5B that the simulation of the pump with the inducer PM1 that the velocity of the fluid starts to increase only slightly before reaching the leading edge of the inducer, at line A, and then the velocity gradient of the slurry gently and smoothly increases as the slurry travels from the leading edge of the inducer at line A to the leading edge of the impeller at line B. The smooth velocity gradient of the velocity plot I, as the slurry travels from the leading edge of the inducer to the leading edge of the impeller, contrasts with the velocity plot NI of the pump without the inducer PM1, in which the velocity of the slurry does not begin to increase until it nears the leading edge of the impeller, at line B.

Figure 9:
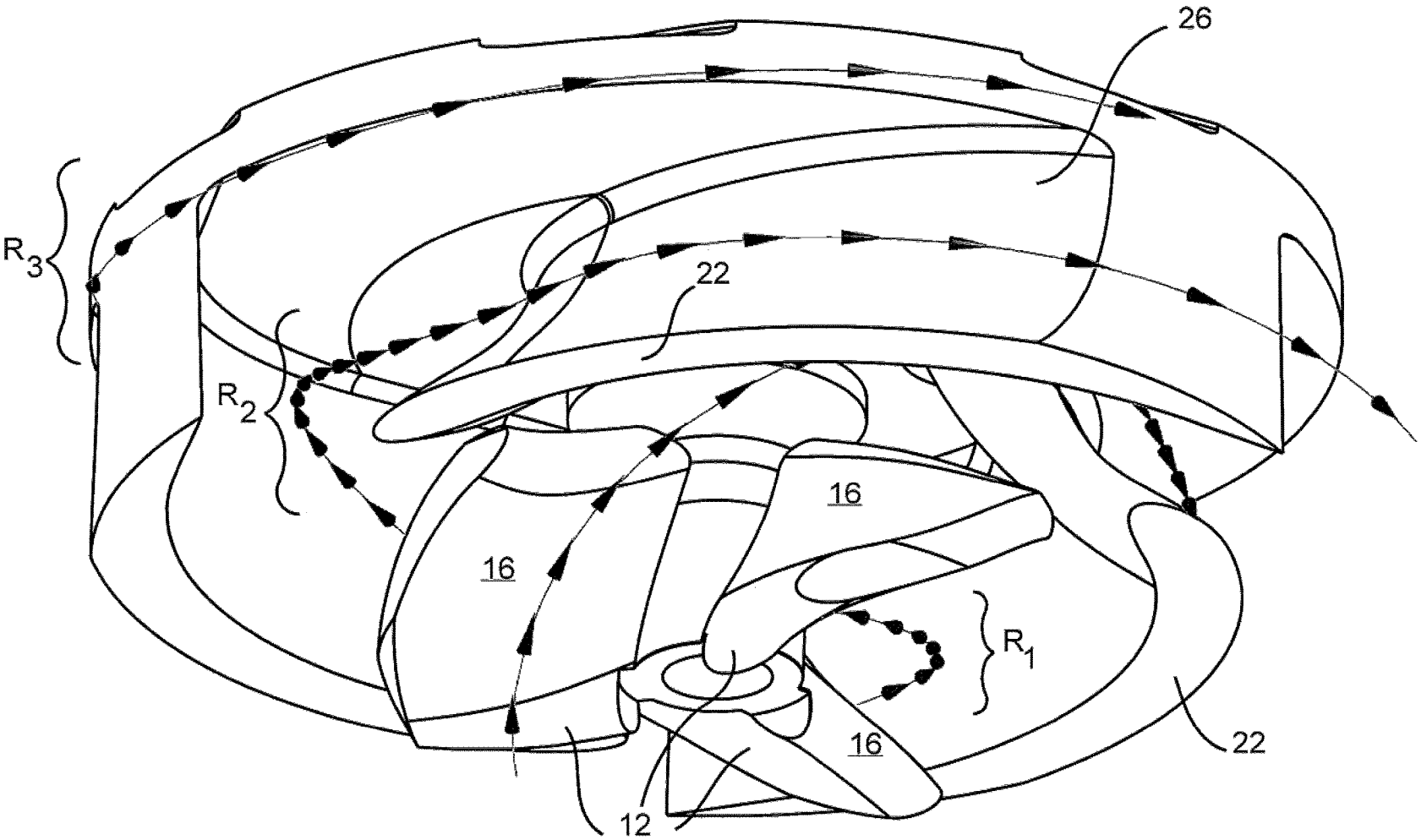
FIGS. 9 and 10 are perspective views of an inducer according to the present disclosure, the inducer mounted so as to be nested into an impeller and showing arrows indicating the direction and magnitude of flow.
Figure 10:
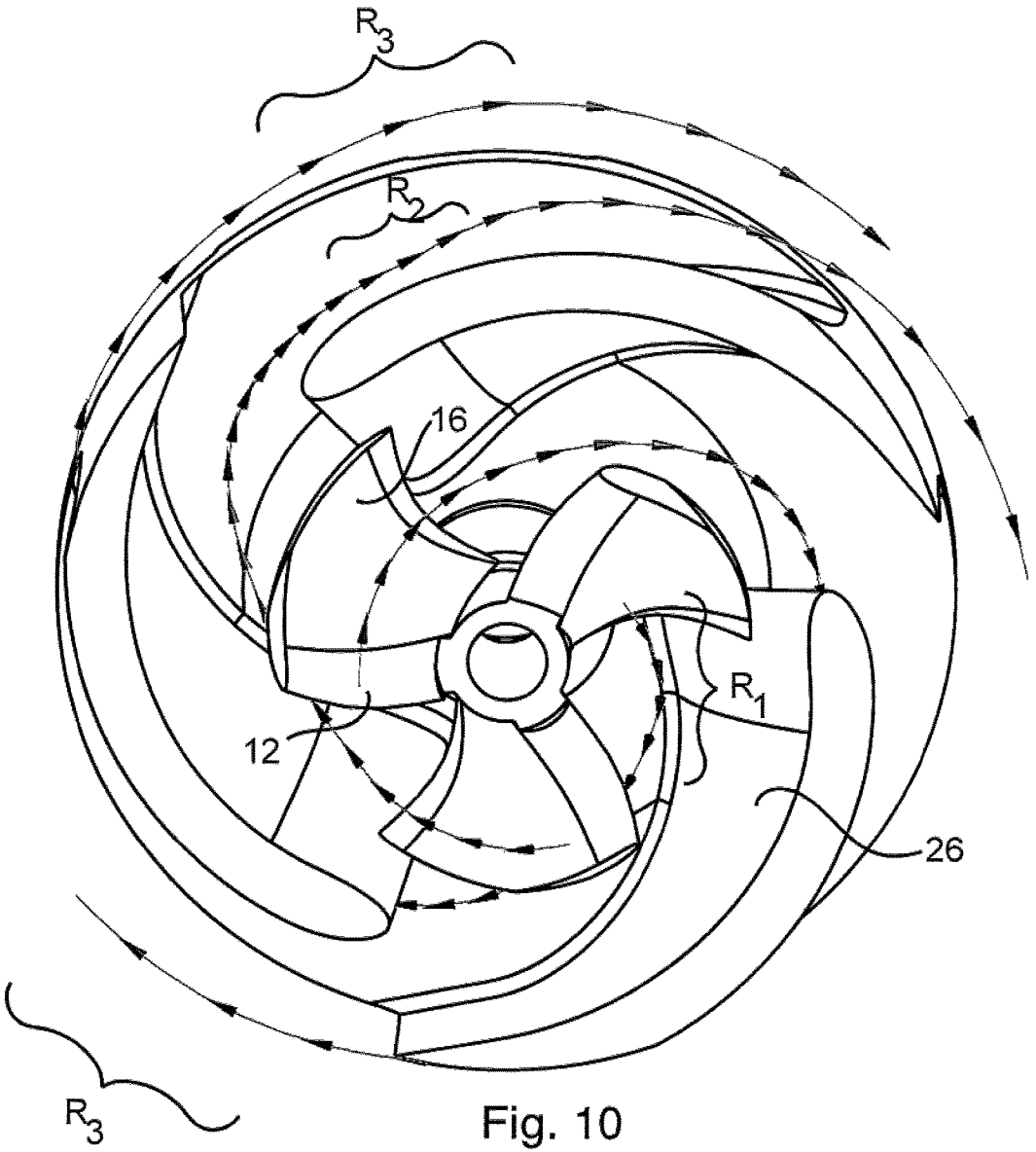
Figure 11:
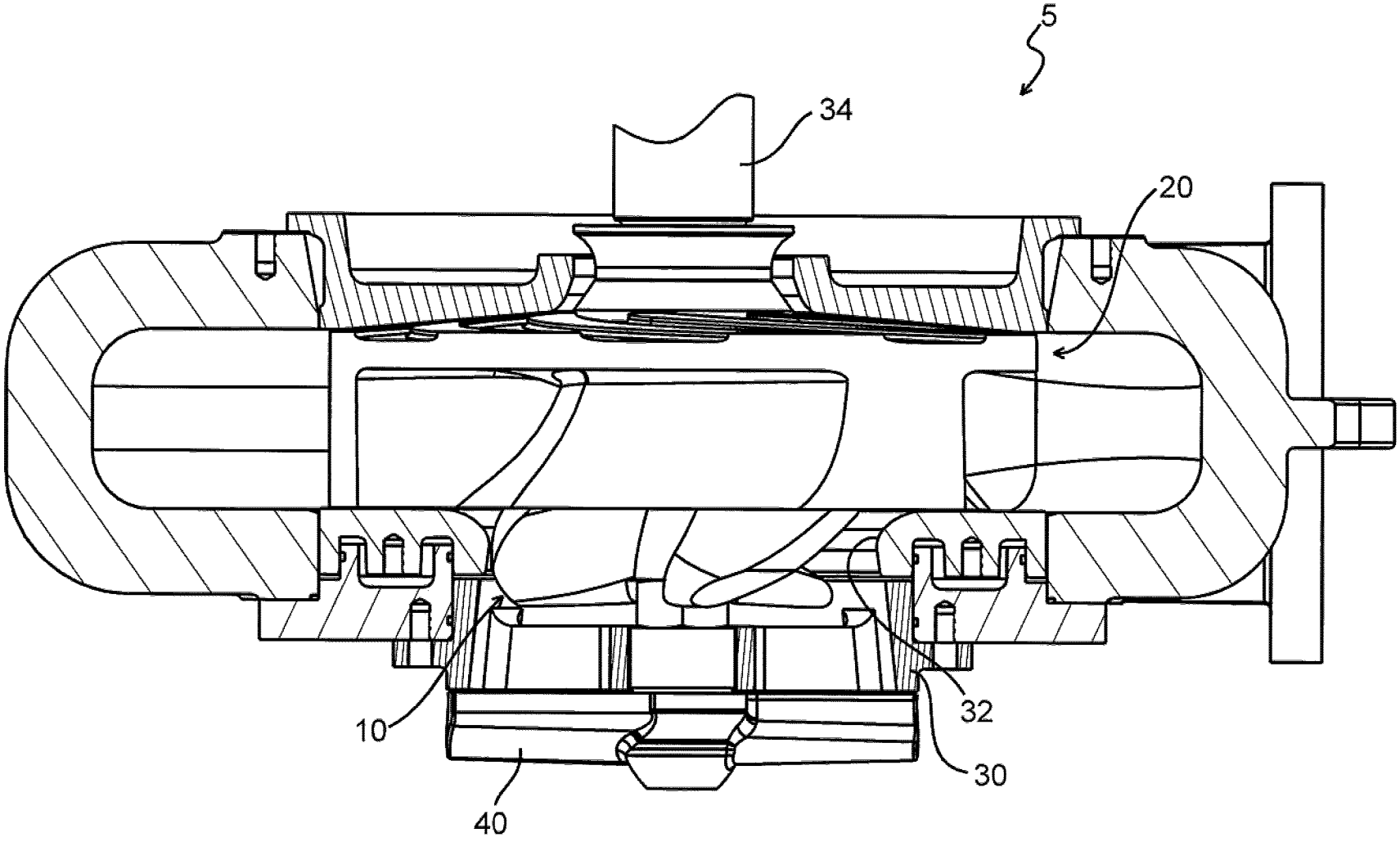
FIG. 11 is a sectional view of a submersible pump, the pump incorporating the inducer and impeller arrangement shown in FIG. 3.
Figure 12:
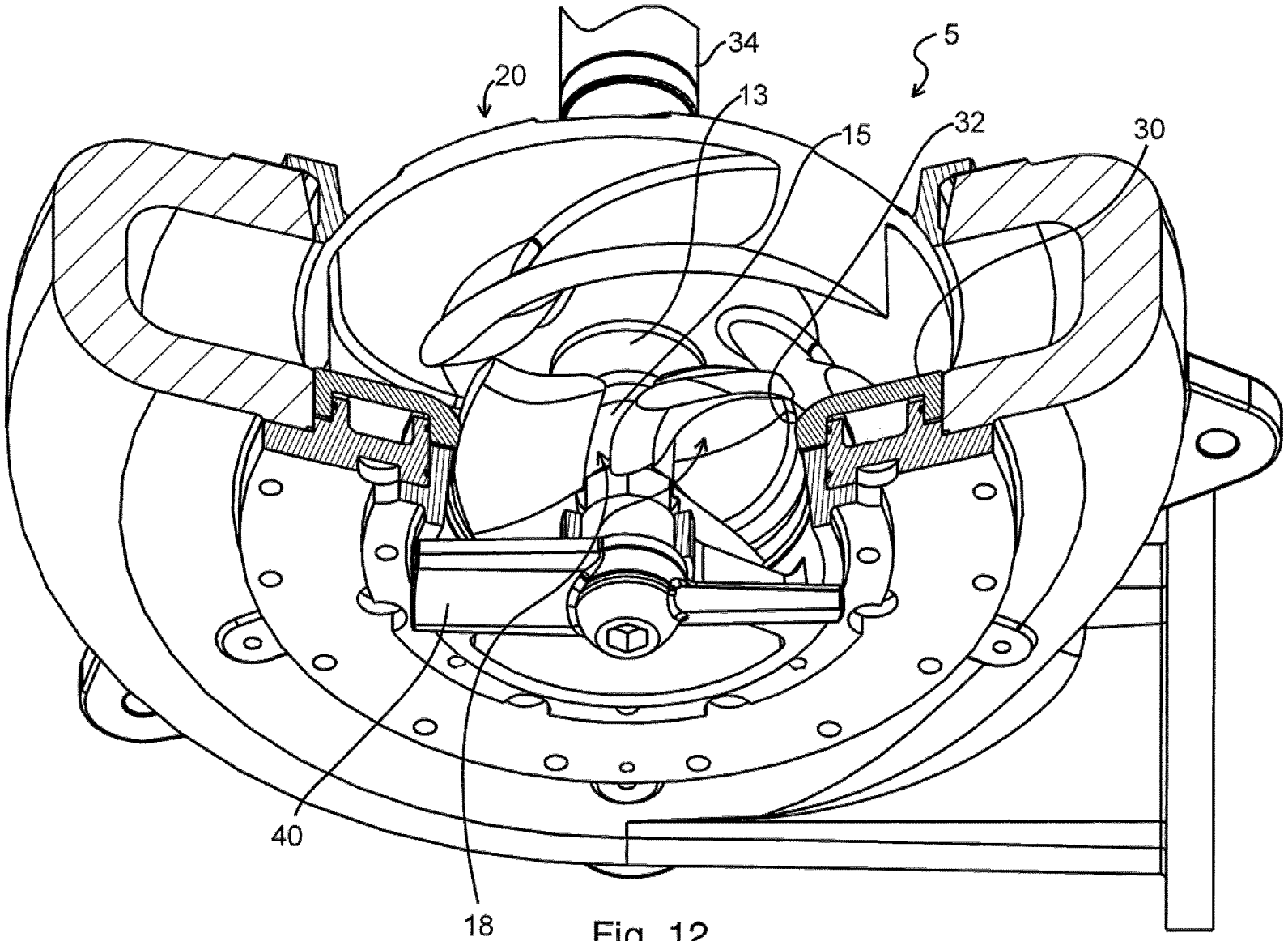
FIG. 12 is a partially cut away, perspective view of the submersible pump shown in FIG. 11.

The velocity of the fluid observed during simulations may also be viewed in FIGS. 9 and 10, which display a plurality of arrows $R_1$ to $R_3$, which arrows indicate the direction and velocity of the fluid path through the inducer and the impeller, with the length of the arrows indicating the relative magnitude of the flow velocity. As may be seen, the fluid flows at a lower velocity as indicated by the plurality of arrows $R_1$ having the shortest length, as the fluid flows past the leading edges 12 and in between the inducer blades 16. The velocity gradually increases as the fluid passes from the inducer blades 16 to the impeller blades 26, as indicated by the plurality of arrows $R_2$, and the velocity of the fluid steadily increases as the fluid reaches the trailing edge 24 of the impeller blades 26, as indicated by the plurality of arrows $R_3$ having the longest length.

Advantageously, the applicant observed during simulations that the power draw of the pump configured with the illustrative PM7 inducer disclosed herein was approximately 1.9% lower than the power draw of the same pump without the inducer. Although the addition of the inducer to the drive shaft adds weight and drag loading to the drive shaft, thereby increasing the power draw required, the inducer also assists the impeller with achieving the head or pressure rise required and improves the overall fluid flow, thereby resulting in a net decrease in the power draw of the pump. In other inducers designed in accordance with the present disclosure, the Applicant has observed a power draw reduction of up to 4.4% lower with the addition of the inducer to the pump system.

Figure 15:
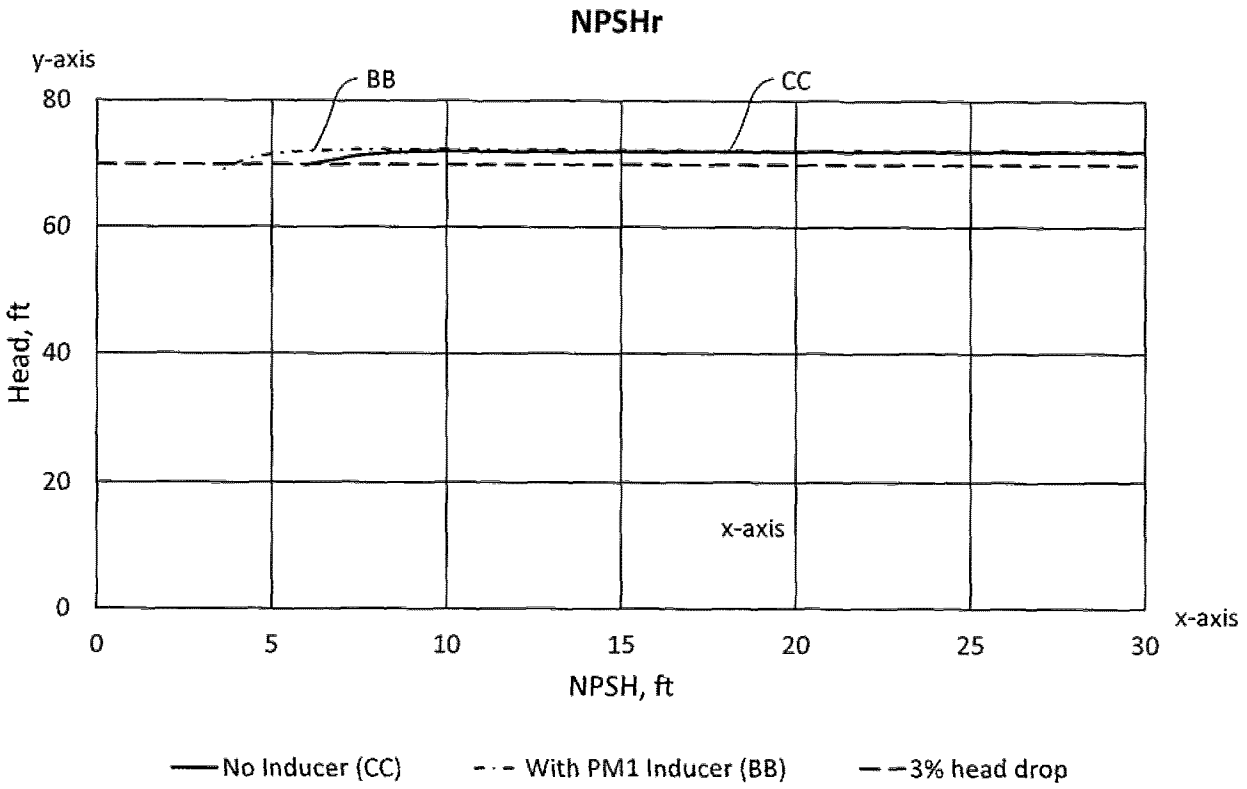
FIG. 15 is a graph showing the $NPSH_R$ of a pump incorporating an inducer in accordance with the present disclosure as compared to the $NPSH_R$ of the pump without the inducer.

The $NPSH_R$ of the pump was deduced to either remain the same or improve with the addition of the inducer disclosed herein, based on the velocity profiles obtained from simulations of earlier proposed inducer designs and comparing those prior results to the velocity profiles obtained for the present inducers, and compared to the velocity profiles obtained for the same pump without the inducer. Specifically, the deduction that adding the inducer disclosed herein to the pump system likely caused the $NPSH_R$ of the pump to either remain the same or improve, was accomplished by comparing the measured head obtained at one inlet pressure or $NPSH_A$ value as between a pump with the inducer and the same pump without the inducer, as the applicant has observed during simulations, with the result that the pump configured with the inducer reduced regions of low pressure. Furthermore, as illustrated in FIG. 15, a graph showing the $NPSH_R$ of the pump incorporating the PM1 inducer, represented by the dash-dot line BB, as compared to the $NPSH_R$ of the pump without the PM1 inducer, represented by the sold line CC, is provided. As shown in FIG. 15, the pump head remains level at a lower $NPSH_A$ value with the inducer (line BB), as compared to without the inducer (line CC). The head of the pump including the inducer does not decrease by 3% until it reaches a lower pressure, as compared to the pump without the inducer, which illustrates that the cavitation/NPSH performance is better for the pump incorporating the PM1 inducer, as compared the pump without the inducer.

A detailed description of the illustrative example of the PM7 inducer disclosed herein follows, with reference to FIGS. 2-12. However, it will be appreciated by a person skilled in the art that the principles described herein utilized to design an inducer configured to decrease the acceleration of a slurry comprising a highly viscous fluid, which also includes large solids of varying dimensions, may also be applied to designing inducers for other submersible pump configurations, and that such modified inducer designs are intended to be included in the scope of the present disclosure. As can be seen in FIGS. 2-12, the inducer 10 comprises thick blades, a relatively small wrap angle and relatively wide open channels 18 defined between the inducer blades that are relatively short in length, as compared to typical inducers. The fluid path F of the fluid travelling through the inducer channels 18 is only slightly longer than the length L of the inducer blades measured from the leading edge 12 to the trailing edge 14 of the blades. For example, a channel 18 is illustrated in FIGS. 2, 4A, 9 and 10-12, and is defined as the space between first and second adjacent inducer blades 16*a*, 16*b*. Similar channels 18 are defined between each pair of inducer blades 16.

The hub 13 of the inducer includes a slight, gradual increase in diameter from the leading to trailing edges 12, 14 of the inducer blades, and then the diameter of the hub 13 increases dramatically between the trailing edges 14 of the inducer blades and the outlet end 13*c* of the inducer hub. An increasing diameter from the inlet end to the outlet end of the hub 13 has been found to be advantageous as the increase in diameter, it has been found, helps the fluid pressure to increase more gradually and reduces the potential for flow separation. The higher increase in diameter of the hub, downstream of the trailing edges 14, advantageously provide a smoother flow pathway from the nearly vertical inducer hub to the nearly horizontal impeller hub.

The thickness of the blades, for example in the illustrative example of the PM7 inducer 10, may vary throughout the blade, depending on which point on the blade the thickness is measured. In general, the inducer blade 16 is thicker at the hub and thinner at the free edge of the blade. For example, without intending to be limiting, at the hub layer the thickness $T_1$ of the blade may be 40 mm at the leading edge 12, as shown in FIG. 4A, and the thickness $T_2$ at the hub layer at the trailing edge 14 may be 50 mm, as shown in FIG.

4B. Whereas, the thickness $T_3$, measured at the shroud layer or free edge of the blade, may be 25 mm. In other examples of inducers designed in accordance with the present disclosure, the blade thickness may be substantially uniform throughout the blade. In one example, the inducer had a blade thickness ($T_1$, $T_2$ and $T_3$) of substantially 9 mm, and in a further example, the blade thickness ($T_1$, $T_2$ and $T_3$) was 16 mm. It will be appreciated by a person skilled in the art that the above blade thickness dimensions are provided as an example only, and are not intended to be limiting. For example, to design an inducer for a larger or smaller pump, the blade thicknesses may be determined by defining the thickness of the inducer blades relative to an outer diameter D of the inducer blades 16, as measured at the largest outer diameter of the inducer blades 16. For example, the outer diameter D, as measured through the axis of rotation Z and a midway point P located approximately between the leading edge 12 and a trailing edge 14 of an inducer blade 16; a thickness of each blade 16 may be defined by a ratio of the outer diameter D to the blade thickness T (eg: $T_1$, $T_2$ or $T_3$), wherein that ratio ranges between approximately 7 and 14. In the illustrative example of the PM7 inducer, which is not intended to be limiting, the larger ratio of 14 defines the thickness ($T_3$) of the blades at the shroud layer of the inducer, whereas the smaller ratio of 7 defines a thickness ($T_1$) of the blades at the hub layer of the inducer.

In the prior art, such as in the Gulich textbook mentioned above, it is conventional for an inducer blade to have a sweep back angle of approximately 65° to 90°. In another aspect of the present disclosure, as seen in FIG. 4C, the inducer blades 16 are swept back at a reduced sweep angle S of approximately 25° at the leading edge 12, relative to the direction of rotation X of the inducer. The smaller sweep angle of 25° was surprisingly found to work in the example of the PM7 inducer. Although a larger sweep angle was theoretically possible to achieve while still being able to pass large solids through the inducer, implementing a larger sweep angle would have also resulted in changing the shape of the blade; for example, the inlet angle β would have been required to increase more rapidly shortly after the leading edge. The applicant observed that a smoother, flatter velocity curve was achieved with a lower sweep angle S in the PM7 example of an inducer. However, for other inducers designed in accordance with the present disclosure, it is preferable to maintain a larger sweep back angle in the range of approximately 65° to 90°, where the pump geometry and the size of solids to be passed by the pump allows for larger sweep back angles.

The profile of the leading edge 12 of the example PM7 inducer, as viewed for example in FIG. 2, is substantially straight (ie: linear) and radial, having a constant axial value. However, in other inducers designed in accordance with the present disclosure, the leading edge may be tapered back so as to be farther back on the shroud side as compared to the hub side. The profile of the trailing edge 14 is also substantially straight, but the trailing edge 14 extends farther in the axial direction Y (parallel to axis of rotation Z) along the hub 13 than at the shroud layer. The applicant has observed during simulations that this trailing edge profile contributed to a relatively smooth, flat velocity profile of the fluid flowing through the inducer towards the impeller. Because of the nesting of the outlet end of the inducer in the inlet end of the impeller and the resulting close adjacency of the trailing edges 14 of inducer blades 16 to the leading edges 22 of the impeller blades 26, the shroud layer of the trailing edge 14 could not be extended any further axially in direction Y', as doing so would otherwise interfere with the impeller blade's leading edge 22. However, it was found that there was room for the trailing edge 14 to be extended further axially in direction Y along the hub 13. As best viewed in FIG. 6, this feature of the profile of the trailing edge 14 of blade 16 helps bring the inducer blade's trailing edge 14 closer to the impeller blade's leading edge 22, thereby reducing the gap G between the inducer blades 16 and the impeller blades 26, thereby assisting in passing large solids from the inducer to the impeller.

During simulation testing of various configurations of inducers and impellers coupled to the drive shaft, the applicant observed that the positioning of the inducer relative to the impeller plays a role in achieving the smooth, relatively flat velocity profile of the slurry as it flows through the inducer and the impeller. Configurations of inducers having a substantially horizontal trailing edge profile and which were therefore positioned farther away from the impeller along the drive shaft were observed by the applicant, during simulation testing, to result in a significant velocity decrease as the slurry flowed between the inducer and the impeller. In other simulation tests in which the same inducer, having a substantially horizontal trailing edge when viewed in side profile of the inducer, wherein the inducer was positioned as close to the impeller as possible, the applicant observed the velocity decrease remained relatively significant, due to the lack of extending the trailing edge 14 of blade 16 in axial direction Y along the hub 13.

Figure 1C:
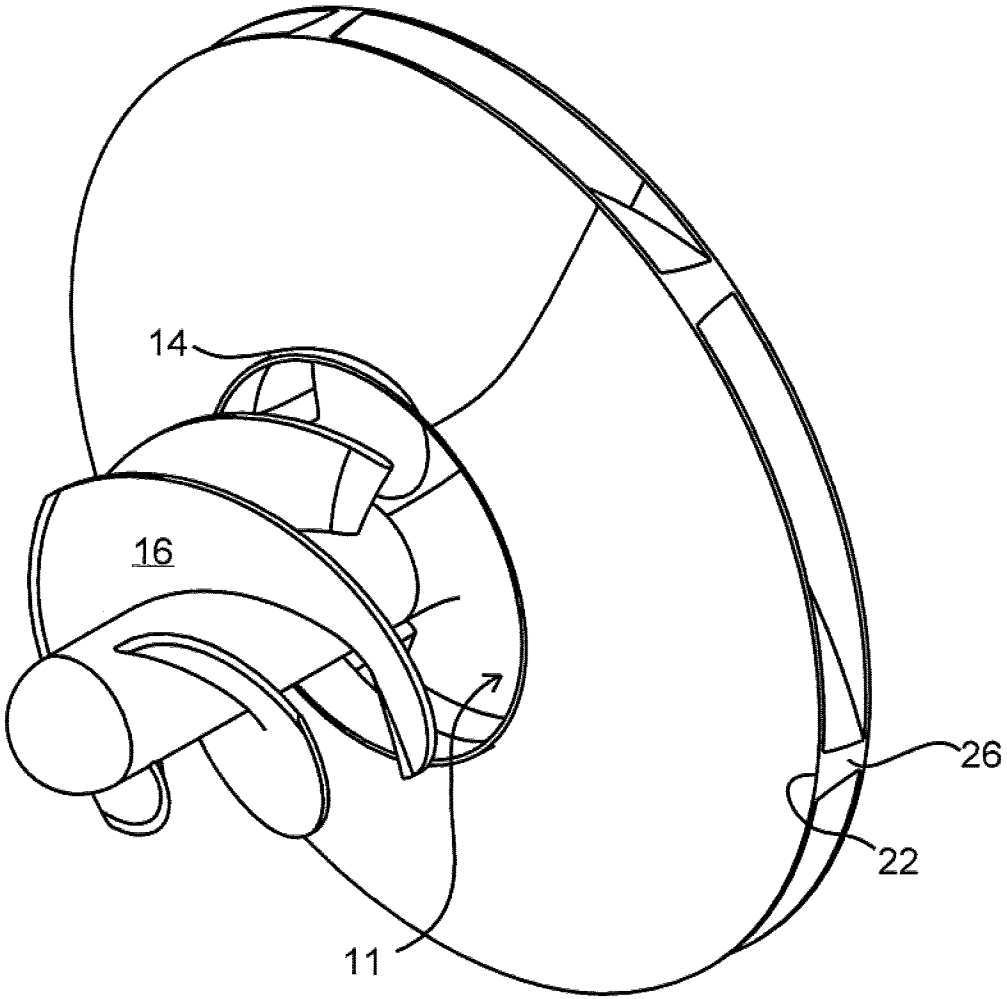
Fig. 1C (Prior Art)
FIG. 1C is a perspective view of a third example of a prior art inducer coupled to an impeller.

Achieving the close positioning between the trailing edges 14 of the inducer blades and the leading edges 22 of the impeller blades also resulted in significant nesting of the inducer within the impeller. In applicant's experience, conventionally the inducer is positioned upstream, outside of and adjacent to the inlet eye 11 of the impeller blades, as seen in FIG. 1C, such that the trailing edges 14 of the inducer blades 16 are upstream, outside of and adjacent to the leading edges 22 of the impeller blades 26; for example, see the illustration of a prior art inducer-impeller arrangement in FIG. 1C. However, such a typical inducer-impeller arrangement results in a significant distance between the inducer blades 16 and the impeller blades 26. Whereas, in the inducer/impeller arrangements disclosed herein, as best viewed for example in FIG. 7, approximately 10% to 40% of the total length L of the downstream or outlet end of inducer blades 16 are nested within the inlet eye 11 of the impeller 20. Thus, approximately 90% to 60% of the total length L of the inducer blades 16 remain upstream of the leading edges 22 of the impeller blades 26.

In FIG. 2, it may be observed that the leading edge blade tips 12*a* of the inducer blades 16 are cut back or rounded, such that the outer diameter of the inducer right at the leading edge 12, is shorter than the rest of the blade's outer diameter D. This cut back was found to reduce pressure pulsations at lower flow rates and when there is low $NPSH_A$, thus improving the general cavitation performance. A cut back angle α of approximately 25° was found to be effective for the illustrative example of the PM7 inducer. However, this is not intended to the limiting; in another example of an inducer designed in accordance with the present disclosure, the cut back angle was 55°, and the leading edge was tapered back; the angle of the cut, with respect to the angled back leading edge, was 44° in that example. The blade tips 14*a* at the trailing edges 14 of the blades, in the PM7 inducer example, are also slightly cut back or rounded, as can be seen in FIG. 6. This is because the inducer 10 is very close to the impeller 12 at that point, so cutting or rounding back the blade tip 14*a* provides additional clearance for machining tolerances. However, in other inducers designed in accordance with the present disclosure, the trim may be more dramatic depending on the geometry of the impeller. In another example of an inducer, the trim back was extensive.

It will be appreciated by a person skilled in the art that certain characteristics of the inducers disclosed herein may be modified so as to optimize the inducer for pumping a slurry containing larger solids, for example having a diameter exceeding 130 mm; or conversely, a slurry containing smaller solids, for example solids having a diameter less than 130 mm.

Referring to FIGS. 2-12, to modify an inducer for pumping a viscous slurry containing solids with a diameter not exceeding 130 mm, the inducer channels 18 may be adapted to receive larger solids by, for example, decreasing the wrap angles WS and WH. Furthermore, the distance between the inner surface 32 of the pump casing 30 and the outer surface 15 of the hub 13 would need to be at least equal to the maximum diameter of the solids within the slurry, such that the inducer channels 18 are sufficiently large enough to receive a flow of the slurry containing solids having up to the maximum diameter. For example, without intending to be limiting, if the maximum diameter of solids within the slurry was 180 mm, then the smallest distance between the outer surface 15 of the hub 13 and the inner surface 32 of the casing 30 would need to be at least 180 mm.

On the other hand, for an inducer designed to pump a viscous slurry which does not contain large solids, but which may include, for example, small and abrasive solids such as rocks or pebbles, certain design limitations of the inducer would not need to be as restricted when optimizing the inducer design. For example, such an inducer for pumping a viscous slurry may include larger wrap angles WH and WS, smaller inlet angles β and larger reverse sweep angles S at the leading edge 12 of inducer blades 16, for example such sweep angles may be in the range of up to 60° to 90°.

In many cases, the inducer designs disclosed herein are very unlike a theoretical inducer design, which inducers are typically designed for improving $NPSH_R$ rather than for improving the velocity profile of a viscous slurry flowing through the inducer and between the inducer and the impeller and then through the impeller. Velocity plots such as seen in FIG. 5 were analyzed to observe how different inducer design parameters affected the flow of the slurry. The pump performance was also analyzed to ensure pressure rise was not hindered and that the power draw did not increase. A methodology for designing inducers for submersible slurry pumps, which must pass large solids, is described in the following section.

Inducer Design Methodology

In one aspect of the present disclosure, an example of the methodology is provided for designing inducers configured to work with a submersible slurry pump designed to pass large solids, as defined elsewhere herein.

When designing a new inducer in accordance with the present disclosure, the inducer constraints are defined as follows:

a) Maximum solid size to be passed by the pump, through the inducer and the impeller, defined by the pump geometry, based on the following:
   i. The minimum spacing in between the impeller blades;
   ii. The minimum spacing in the impeller between the hub and shroud surfaces;
   iii. The minimum spacing between the impeller outer diameter and the nearest volute casing wall, usually the cutwater;
   iv. The throat size of the volute casing near the cutwater. This is where the geometry changes from the spiral to a discharge pipe; and
   v. The diameter of piping elsewhere in the pump system.
b) Pump suction diameter: this is the size of the opening into the casing of the pump where the impeller is located.
c) Diameter of the leading edge of the impeller blades which often varies from the hub to shroud of the impeller.
d) Required shaft size through the inducer: this may depend on if there are any components upstream of the inducer. In a vertical arrangement, these additional components would be below the inducer. These components could include a cutter/chopper and/or an agitator.

The identified constraints will influence the design parameters of the inducer, as follows:

a) Maximum solid size: the inducer must be designed such that a solid of the maximum solid size can travel from the leading edge to the trailing edge of the inducer blade and continue through the impeller without blockage. This will likely impose a maximum number of blades that can be used, and often limits the shape of the blades. Inducer blades are typically helical and the spacing between blades is generally much smaller than the limit imposed by the solids the pumps are intended to pass. The solid size also influences the required thickness of the blades. Slurry pump impeller blades are designed much thicker than typical centrifugal pumps to withstand increased wear from abrasion and impact; the inducer blades are subject to the same effects. The thickness of the blades can generally be thinner than the impeller blades, since the tip speed of the blades measured in meters/second (as opposed to angular or rotational speed in rotations per minute, which is constant for all the components rotating on the same drive shaft), is less than the larger diameter impeller. The thickness of the blade imposes further limits on the shape of the inducer blade, because thicker blades decrease the width of the channels defined in between the inducer blades, thereby reducing the clearance between the inducer blades for solids to pass.
b) Pump suction diameter: this can impose a limit on the outer diameter of the inducer blades. The suction diameter is typically designed to be smaller than the diameter of the leading edge of the impeller blades on the shroud side (which is closest to the suction). The Applicant has observed that at the point where the suction diameter is reduced, the velocities increase as there is a decrease in area, essentially forming a nozzle. Since one of the primary goals of the inducer design is to achieve a smooth velocity gradient, it was found that this was not achieved when the suction diameter was not constant. Applicant has found that it is difficult to nest the inducer in the impeller eye on conventional impellers. Applicant has found that nesting is best facilitated with pumps having a constant suction diameter and a constant inducer outer diameter. That said, the applicant notes that a non-constant suction diameter and/or a non-constant inducer outer diameter could still be utilized in the present disclosure, although such a configuration may make it more difficult to achieve a smooth velocity gradient.
c) Diameter of the impeller blade leading edge: this constraint imposes limits on the inducer diameter, more towards the inducer trailing edge. Typically, the diameter of the impeller leading edge on the hub side is smaller than the diameter of the impeller leading edge on the shroud side. With an inducer nested inside the impeller eye as much as possible, it is likely that even with a constant suction diameter and constant inducer diameter, the inducer blades will still need to be trimmed near the trailing edge in order to provide clearance from the impeller blade nearer to the hub side. This also means further consideration must be taken into ensuring there is enough space to pass the maximum solid sizes between the inducer and the impeller.

d) Required shaft size: this constraint imposes limits on the hub diameter of the inducer. If a shaft must go through the entire hub of the inducer and especially if it must hold load bearing components such as a cutter/chopper or agitator, the inducer hub must be large enough to accommodate this shaft. The Applicant has observed the hub size needs to be small in order to provide enough clearance for solids between the hub of the inducer and the shroud diameter which is the suction diameter of the pump. In the prior art, it is usually preferred to have a smaller hub size in order to achieve a design closer to theoretical design recommendations and achieve better parameters such as suction specific speed. Suction specific speed is a dimensionless parameter used to evaluate a pump's suction capability and essentially how well it performs regarding $NPSH_R$. A lower (and thus better) $NPSH_R$ will correspond to a higher suction specific speed.

Once the constraints of the inducer are identified, the primary design parameters of the inducer are calculated, based on theoretical calculations. The primary parameters include: the inducer hub diameter, inducer blade outer diameter, blade inlet angles and blade outlet angles. Optionally, a recommended range for the inducer blade chord length at the shroud side may also be included in the primary design parameters. The chord length is the length of the blade from leading edge tip to trailing edge tip if the inducer blade was "unrolled" and "flattened". The chord length is based on the diameter of the blade, the wrap angle, and the axial length of the inducer from the leading edge to the trailing edge.

Applicant believes that conventional design theory for ideal inducers requires a suction specific speed of 400-700 in order to perform well regarding $NPSH_R$. However, with the constraints required for submersible slurry pump inducers designed to pass large solids, it may not be possible or needed to achieve a suction specific speed in this range. However, the goal is to achieve a suction specific speed that approaches the ideal range, by modifying the primary parameters. For example, the hub diameter may be minimized, and be designed to have an increasing diameter from leading edge to trailing edge. The Applicant observes this helps pressure to build up slowly as area decreases with increasing hub diameter, and this modification can also help avoid flow separation. Furthermore, the inlet blade angles may be selected to achieve the best suction specific speed.

Other primary design parameters, such as the inducer blade outer diameter and the blade inlet and outlet angles, may be modified so as to approach the parameters of an ideal non-slurry pump inducer according to theory. Although the applicant found it is often not possible to select these primary parameters to fall within the recommended theoretical ranges for an ideal inducer, given the constraints, the applicant would select primary design parameters to approach the theoretical recommendations for those parameters. Several of these parameters may be well outside the recommended ranges, which illustrates the uniqueness of the inducers disclosed herein. For example, the applicant has found the outer diameter of the inducer is typically much smaller than the theoretically recommended diameter, due to the limitations imposed by the suction diameter of the pump. Due to the outer diameter constraint, the blade angles were larger than what is theoretically common. Based on calculations, the blade angles may be defined as small as possible given the existing constraints.

The next step is to utilize design software to input the primary parameters calculated above to generate the secondary parameters for the possible inducer designs. The secondary parameters, which may be identified with the assistance of design software, include:

a) Number of inducer blades
b) Wrap angle of the inducer blades from leading edge to trailing edge
c) Progression of the blade angles from the leading edge to trailing edge
d) Chord length of the blade
e) Sweep angle of the blade, especially at the leading edge
f) Tapering of the leading edge and/or trailing edge axially
g) Trimming of the leading edge and/or trailing edge towards the shroud side. These parameters will be trimmed at an angle such that the blade is trimmed back both radially and axially at the corner of the leading edge and shroud and/or trailing edge and shroud.

To the extent possible, given the constraints, the secondary parameters may be selected in accordance with theory for an ideal inducer designed for a non-slurry submersible liquid pump, and then modified for pumping slurries containing viscous fluids and large solids. The conventional ranges for each of the secondary parameters include the following:

a) The inducer should have two to four blades.
b) The inducer blade angles should be kept constant over the first approximately 25% of the blade lengths. This helps reduce any low-pressure peaks that would cause cavitation.
c) The chord length of the blade on the shroud/outer side is recommended to be within the range of the pitch multiplied by a factor of 1.5 to 1.8. The pitch is calculated as the circumference of the inducer blade outer diameter divided by the number of blades. If not possible to be within the range of 1.5 to 1.8, the chord length of the blades should be within the range of the pitch multiplied by a factor of 1 to 2.5.
d) The inducer blade leading edge should be swept back. It is typically recommended to sweep it back between 65° to 90° at the outer/shroud side with respect to the inner/hub side. This helps increase the suction specific speed and reduce pressure pulsations which could cause cavitation.
e) The inducer blade leading edge should also be tapered back axially such that the shroud side of the leading edge is farther back than the hub side of the leading edge with respect to a line extending radially outward from the hub. This helps increase suction specific speed and reduces pressure pulsations.
f) The inducer blade should be trimmed axially and radially at the leading edge/shroud corner which will leave a larger gap between the blade and the shroud or suction diameter of the pump. This helps reduce pressure pulsations especially when the pump operates at lower flow rates and at a low $NPSH_A$.

g) The inducer blade may need to be trimmed axially and radially at the trailing edge/shroud corner to provide clearance between the inducer blades and the leading edge of the impeller blades. It may also help to taper the trailing edge of the blade such that the hub side of the trailing edge is farther back axially than the shroud side with respect to a line extending radially outward from the hub to provide clearance and fit well within the impeller eye.

The next step involves adapting the primary and secondary parameters for the design constraints identified in the earlier steps. Usually, the most limiting constraint is the maximum solid size that the inducer must pass. Each of the primary and secondary parameters may be modified to allow for larger solids to pass, than would otherwise be possible in a conventional submersible liquid pump of the prior art.

As described herein, when the number of inducer blades matches the number of impeller blades (such as, three impeller blades and three inducer blades), or if the number of impeller blades is a multiple of the number of inducer blades (such as, four impeller blades and two inducer blades), such a configuration would advantageously enable the alignment of the trailing edge of each inducer blade with a leading edge of an impeller blade, thereby providing sufficient room for a large solid to pass from the inducer to the impeller, a reduced radial gap between the trailing edge of the inducer blades and the leading edge of the impeller blades, and enables fluidical alignment between the channels created by the inducer blades and the channels created by the impeller blades, all of which, the applicant has found, assists with smoothing the velocity curve of the fluid as it passes from the inducer to the impeller.

Other secondary parameters which may be modified includes the reduction of the sweep angle. In the example of the PM7 inducer, the sweep angle was reduced to 25 degrees, which provides more clearance for passage of the large solids. Tapering the leading edge axially and trimming the leading edge/shroud corner may also provide more clearance at the leading edge of the inducer blades. From the leading edge to the trailing edge, the space between the blades should enable the maximum size large solids to pass. In some designs, it was possible to maintain a consistent blade angle over the first 25% of the blade length starting at the leading edge of the blade, and then allow the blade angle to gradually change to the selected outlet angle. Taking the PM1 inducer as an illustrative example, the inlet blade angle was 50.5 degrees at the hub and 31.7 degrees at the shroud. The blade angle was maintained at these values for approximately the first 25% portion of the blade length, measured from the leading edge of the inducer blade. Then, the angle begins to vary along the blade length, increasing to become 80.5 degrees at the trailing edge at the hub layer and 67 degrees at the trailing edge of the shroud layer. To provide another illustrative example, the PM7 inducer did not allow for the inlet blade angle to be maintained at a constant value over the first 25% of the blade length, measured from the leading edge of the blade. In that example, the inlet blade angle varied substantially throughout the entire length of the inducer blade, from the leading edge to the trailing edge of the blade.

The wrap angle, chord length and sweep angle from leading edge to trailing edge were the other secondary parameters adjusted to ensure solids could pass through the blades of the inducer. In extreme cases for inducers designed to pass very large solids, the wrap angle may need to be very small (such as, less than 100 degrees), and the chord length may need to be relatively small (as compared to the recommended chord length for submersible liquid pumps, according to theory) so as to accommodate the large solid sizes. While a low wrap angle and high chord length would be possible, the blades would be nearly axial, would draw excessive power, and would increase the velocity of the slurry too high, such that the velocity would then decrease before entering into the impeller and then increase again through the impeller. That said, a shorter chord length combined with the small wrap angle allowed for a more ideal and helical shaped inducer. Finally, the sweep back of the blade past the leading edge may also need to be limited to ensure sufficient spacing within the inducer for passage of large solids.

The trailing edge design of the inducer blade may be based upon the impeller leading edge dimensions as well as the maximum solid size constraint. The Applicant has observed that the blade trailing edge/shroud corner is trimmed axially and radially to provide sufficient clearance between the inducer and impeller blades. This trim also helps achieve the required maximum solid size. The trailing edge is often tapered axially such that the hub side is further back axially than the shroud side with respect to a line extending radially outward from the hub. This helps bring the inducer trailing edge closer to the impeller leading edge, thus providing a smoother flow transition between the inducer and impeller. Such parameter also assists with achieving sufficient clearance through the inducer for the maximum solid size constraint.

The next step in the method includes simulating one or more simulation inducers, the simulation inducers designed in accordance with the constraints and primary and secondary parameters discussed above. For example, the one or more simulation inducers may be simulated using CFD software, and the results analyzed to observe whether or not the intended outcome of a smoother and flatter velocity curve of the pumped media as it moves through the inducer to the impeller is achieved, wherein the desired outcome is that the velocity gradient is smoother and increases gradually as the pumped media travels into the impeller. The secondary desired outcomes include that the $NPSH_R$ is as good or better with the inducer, as compared to simulations run on the pump without the inducer, and that the head and efficiency are not negatively impacted when the inducer is included.

In some embodiments, the steps above may be performed multiple times to obtain an optimized inducer. The secondary parameters listed above may be modified first, to optimize performance while still achieving the identified constraints. Then, the primary parameters determined above may also be modified in order to analyze their effects on the velocity curve of the fluid travelling through the inducer and impeller of the pump.

What is claimed is:

1. An inducer for a submersible slurry pump configured to pump a slurry containing solids and viscous fluids, the pump including an impeller having an impeller blade height and a plurality of impeller blades, the solids having a maximum diameter equal to the impeller blade height of the pump, the inducer configured to be positioned within a casing of the pump and mountable to a drive shaft of the pump so as to be adjacent to and immediately upstream of the impeller mounted on the drive shaft, wherein the inducer and impeller are rotated on the drive shaft in a direction of rotation, the inducer comprising:

a hub, at least two and no more than four inducer blades mounted to and extending axially along the hub, the inducer blades extending outwardly from and wrapping helically around the hub, the hub and the inducer blades thereby defining a plurality of continuous channels, each channel of the plurality of continuous channels bounded by the hub, the inducer blades, the plurality of impeller blades and an inner surface of the casing, wherein a trailing edge of each blade of the inducer blades is configured to be positioned adjacent to and aligned with a leading edge of each corresponding blade of the plurality of impeller blades of the impeller when the inducer is mounted on the drive shaft of the pump and a horizontal plane passing through an axial surface of the leading edge of each corresponding blade of the plurality of the impeller blades intersects the inducer blades, such that a curve representing a velocity of the slurry is substantially smooth as the slurry travels through the plurality of continuous channels from a leading edge of each blade of the inducer blades to the leading edge of each impeller blade of the plurality of impeller blades.

2. The inducer of claim 1, wherein each blade of the inducer blades is swept back relative to the direction of rotation.

3. The inducer of claim 1, wherein an outer diameter of the inducer blades measured at the leading edge of the blades is less than an outer diameter of the inducer blades measured at a midway point, the midway point located between the leading edge and the trailing edge of each blade of the inducer blades.

4. The inducer of claim 3, wherein a ratio of the outer diameter of the inducer blades to a thickness of each blade of the inducer blades ranges between substantially 7 and 14.

5. The inducer of claim 4 wherein the ratio of the outer diameter of the inducer blades to the thickness of the inducer blade is substantially equal to 14 when the thickness is measured at a free edge of the blade distal from the hub and the ratio is substantially equal to 7 when the thickness is measured at an interface between the hub and a leading edge of the inducer blade.

6. The inducer of claim 1, wherein the inducer blades consist of three inducer blades.

7. The inducer of claim 1, wherein a diameter of the hub at an inlet end of the inducer is less than a diameter of the hub at an outlet end of the inducer.

8. The inducer of claim 1, wherein a wrap angle of each blade of the inducer blades is less than 100 degrees.

9. A submersible slurry pump configured to pump a slurry containing solids and viscous fluids, the pump comprising:

an impeller mounted on a drive shaft downstream of and immediately adjacent to an inducer mounted to the drive shaft, the impeller having a plurality of impeller blades and an impeller blade height, a casing of the pump, the casing housing the inducer and the impeller, the inducer comprising:

a hub, at least two and no more than four inducer blades mounted to and extending axially along the hub, the inducer blades extending outwardly from and wrapping helically around the hub, the hub and the inducer blades thereby defining a plurality of continuous channels, each channel of the plurality of continuous channels bounded by the hub, the inducer blades, the plurality of impeller blades and an inner surface of the casing, wherein a trailing edge of each blade of the inducer blades is positioned adjacent to and aligned with a leading edge of a corresponding impeller blade of the plurality of impeller blades of the impeller, thereby defining a radial gap between the two, radial relative to the drive shaft and a horizontal plane passing through an axial surface of the leading edge of each corresponding blade of the plurality of the impeller blades intersects the inducer blades, such that a curve representing a velocity of the slurry is substantially smooth as the slurry travels through the plurality of continuous channels from a leading edge of each blade of the inducer blades to and over the leading edge of each impeller blade of the plurality of impeller blades; and wherein a maximum diameter of the solids is equal to the impeller blade height.

10. The pump of claim 9, wherein the radial gap is substantially in the range of 3 to 6 mm.

11. The pump of claim 9, wherein a velocity of the slurry at a trailing edge of each blade of the inducer blades is substantially equal to a velocity of the slurry at the leading edge of each impeller blade of the plurality of impeller blades when the pump is pumping the slurry.

12. The pump of claim 9, wherein a number of the plurality of impeller blades is a multiple of a number of the inducer blades.

13. The pump of claim 12, wherein the number of inducer blades is equal to the number of impeller blades.

14. The pump of claim 12, wherein the number of inducer blades and the number of impeller blades is equal to three blades.

15. The pump of claim 9, wherein a ratio of the impeller blade height to a corresponding standard impeller blade height for a standard non-slurry pump is selected from a range of 1.5 to 2.5.

16. The pump of claim 9, wherein the inducer is nested within an inlet eye of the impeller, whereby a portion of a length of a downstream end of the inducer blades is nested within the impeller.

17. The pump of claim 16, wherein the portion of the length of the downstream end of the inducer blades nested within the impeller is in the range of 10% to 40% of a total inducer length.

* * * * *